US008936478B2

(12) United States Patent
Choi et al.

(10) Patent No.: US 8,936,478 B2
(45) Date of Patent: Jan. 20, 2015

(54) ELECTRICAL PLUG

(75) Inventors: Min-Kyu Choi, Kyungnam (KR); Paul Thomas, Pimlico (GB); Stefan Dzisiewski-Smith, Henfield (GB); Matthew Judkins, Marlow (GB)

(73) Assignee: Made in Mind Ltd., London (GB)

( * ) Notice: Subject to any disclaimer, the term of this patent is extended or adjusted under 35 U.S.C. 154(b) by 0 days.

(21) Appl. No.: 13/203,194

(22) PCT Filed: Feb. 4, 2010

(86) PCT No.: PCT/EP2010/051387

§ 371 (c)(1), (2), (4) Date: Nov. 17, 2011

(87) PCT Pub. No.: WO2010/089356

PCT Pub. Date: Aug. 12, 2010

(65) Prior Publication Data

US 2012/0058677 A1 Mar. 8, 2012

(30) Foreign Application Priority Data

Feb. 4, 2009 (KR) ..... 10-2009-0009014
Feb. 4, 2009 (KR) ..... 10-2009-0009022

(51) Int. Cl.
*H01R 29/00* (2006.01)
*H01R 31/06* (2006.01)
(Continued)

(52) U.S. Cl.
CPC ..... *H01R 31/06* (2013.01); *H01R 13/447* (2013.01); *H01R 13/502* (2013.01);
(Continued)

(58) Field of Classification Search
USPC ..... 439/131, 31, 171, 172, 173, 142, 11
See application file for complete search history.

(56) References Cited

U.S. PATENT DOCUMENTS 1,485,193 A 2/1924 McKay
5,159,545 A 10/1992 Lee
(Continued)

FOREIGN PATENT DOCUMENTS

CN 2443507 Y 8/2001
CN 2736978 Y 10/2005
(Continued)

OTHER PUBLICATIONS

International Search Report for International Application No. PCT/EP2010/051387 dated May 28, 2010 and Written Opinion of the International Searching Authority for PCT/EP2010/051387.
(Continued)

*Primary Examiner* — Phuong Dinh
(74) *Attorney, Agent, or Firm* — Cooley LLP; Brain P. Hopkins

(57) ABSTRACT

This invention relates to an electrical plug (1; 100; 154; 160; 200; 300) comprising: a plug main body (3; 103; 204; 302); and a plurality of electrical pins (21, 23; 156, 158; 164, 166; 210, 212; 310; 312), the pins being carried by an arm (17; 208; 308) that is coupled to said plug main body (3; 103; 204; 302) and is rotatable relative thereto between a stowed position where the arm (17; 208; 308) is generally linearly aligned with the plug main body (3; 103; 204; 302), and a deployed position where the arm (17; 208; 308) has rotated relative to the plug main body (3; 103; 204; 302) so as to be generally perpendicular thereto. A multi-plug adaptor for use with the plug is also disclosed.

19 Claims, 28 Drawing Sheets

(51) Int. Cl.

| | |
|---|---|
| ***H01R 13/447*** | (2006.01) |
| ***H01R 13/502*** | (2006.01) |
| ***H01R 13/633*** | (2006.01) |
| ***H01R 13/652*** | (2006.01) |
| ***H01R 13/66*** | (2006.01) |
| ***H01R 13/68*** | (2011.01) |
| ***H01R 24/30*** | (2011.01) |
| ***H01R 25/00*** | (2006.01) |
| ***H01R 35/02*** | (2006.01) |
| *H01R 103/00* | (2006.01) |

(52) U.S. Cl.

CPC ..... *H01R 13/6335* (2013.01); *H01R 13/652* (2013.01); *H01R 13/6675* (2013.01); *H01R 13/68* (2013.01); *H01R 24/30* (2013.01); *H01R 25/006* (2013.01); *H01R 35/02* (2013.01); *H01R 2103/00* (2013.01)

USPC ..... 439/172

(56) References Cited

U.S. PATENT DOCUMENTS

| | | | | |
|---|---|---|---|---|
| 5,393,237 | A | 2/1995 | Roy | |
| 5,474,464 | A * | 12/1995 | Drewnicki | 439/172 |
| 5,852,394 | A | 12/1998 | Watanabe et al. | |
| 6,126,460 | A * | 10/2000 | Wu | 439/131 |
| 6,780,034 | B2 * | 8/2004 | Shiroshita et al. | 439/174 |
| 6,840,784 | B2 * | 1/2005 | Chang | 439/131 |
| 7,121,852 | B2 * | 10/2006 | Ng et al. | 439/131 |
| 7,354,286 | B1 * | 4/2008 | Lee | 439/172 |
| 7,484,972 | B1 * | 2/2009 | Kuo et al. | 439/131 |
| 2004/0209500 | A1 * | 10/2004 | Chang | 439/131 |
| 2007/0293072 | A1 | 12/2007 | Honton | |
| 2008/0076279 | A1 * | 3/2008 | Wu et al. | 439/131 |
| 2008/0293303 | A1 | 11/2008 | Liao | |

FOREIGN PATENT DOCUMENTS

| | | | |
|---|---|---|---|
| CN | 1725580 | A | 1/2006 |
| DE | 200 14 987 | U1 | 10/2000 |
| EP | 2140524 | | 1/2006 |
| FR | 2 913 820 | A1 | 9/2008 |
| FR | 2913820 | A | 9/2008 |
| GB | 2 381 669 | A | 5/2003 |
| GB | 2381669 | | 7/2003 |
| GB | 2 417 141 | A | 2/2006 |
| GB | 2 436 465 | A | 9/2007 |
| GB | 2 436 899 | A | 10/2007 |
| WO | 0147071 | | 6/2001 |
| WO | WO 2009/152631 | A1 | 12/2009 |
| WO | WO 01/47071 | A1 | 6/2011 |

OTHER PUBLICATIONS

Search Report and Written Opinion for Singapore Patent Application No. 201105409-5 date Oct. 3, 2012.

Examination and Search Report dated Sep. 30, 2013, for corresponding Chinese Patent Application No. 201080010322.4, filed Feb. 4, 2010 (with English translation).

CIPO Examination Report dated Sep. 30, 2013, for corresponding Chinese Patent Application No. 201080010322.4, filed Feb. 4, 2010 (not translated).

CIPO Search Report dated Sep. 30, 2013, for corresponding Chinese Patent Application No. 201080010322.4, filed Feb. 4, 2010 (not translated).

* cited by examiner

ELECTRICAL PLUG

CROSS REFERENCE TO RELATED APPLICATIONS

The present application is a 35 U.S.C. §371 national stage entry of PCT/EP2010/051387, which has an international filing date of Feb. 4, 2010 and claims priority to Korean Patent Application Serial Nos. 10-2009-0009022 and 10-2009-0009014, both filed on Feb. 4, 2009. The present application incorporates herein by reference the disclosures of each of the above-referenced applications in their entireties.

FIELD

In one aspect the present invention relates to electrical plugs, particularly but not exclusively to three pin electrical plugs for coupling electrical appliances to a source of electrical power. In another aspect the present invention relates to the combination of an electrical plug of the type described herein and a multi-plug adaptor.

BACKGROUND

It is generally the case that electronic devices tend to steadily decrease in size as technology progresses. For example, portable computers from a few years ago tended to be an inch or more in thickness, whereas newer portable computers are significantly thinner. In fact, with the advent of the MacBook Air and iPad, it is now possible for consumers to purchase portable computers that are significantly less than an inch thick.

However, whilst devices such as computers have decreased in size, the electrical plugs that are typically provided as part of the power supply for such computers have changed little in size over the years. The ultimate illustration of this is the three-pin plug that is used in countries such as the UK (inter alia). This plug is roughly 1.75 inches thick at its thickest point (from the rear of the plug to the tip of the earth pin), or in other word three times thicker than an iPad, for example.

Clearly it would be advantageous if the thickness of the UK plug, in particular, could be reduced, and a number of companies have launched plugs which do indeed reduce the size of the traditional three pin plug.

For example Thinplug Ltd has developed and is now marketing a plug called the ThinPlug which comprises an earth pin that can be folded back into the body of the plug. As shown on their website, www.thinplug.com (see also UK Patent No. 2436899), the earth pin of the ThinPlug pivots about an arm that is rotabable relative to the body of the plug between a stowed position where the earth pin is folded away and an operative position where the earth pin is extended.

Whilst the ThinPlug is undoubtedly significantly thinner than traditional three-pin plugs, British Standards (in particular BS1363-1) dictate that a plug with an earth pin that is accessible in use (i.e. when the plug is plugged into a socket), can only be used in applications where an electrical connection to earth through the earth pin is not required. The effect of this is that the ThinPlug is only suitable for applications where the earth pin is a dummy pin used only to retract the protective gates that normally obstruct access to the live and neutral contacts of a three pin socket.

Another previously proposed arrangement that also seeks to address the aforementioned plug thickness problem is disclosed in UK Patent No. 2381669. This patent discloses a plug that comprises an earth pin which is mounted to an arm, the arm being hinged to the main body of the plug so that it can be moved about an axis parallel to the live and neutral pins from a stowed position to an operative position where the live, earth and neutral pins are arranged in a triangle. The plug also includes a flash plate that is hinged to the plug main body and must be pivoted upwards before the plug can be inserted into a socket. The flash plate has a cut-out which allows the plate to fit around the earth pin when the earth pin is in the operative position.

Whilst the plug disclosed in this patent is also substantially thinner than a conventional plug, the fact that the arm carrying the earth pin is hinged to the plug main body means that it would be problematic to electrically couple the earth pin to earth via the hinge. Furthermore, as the earth pin is accessible via the aforementioned flash-plate cut-out when the plug is inserted in a socket, if the earth pin were used for any purpose other than as a dummy earth pin, then the plug would probably not pass British Standards. As a consequence, the plug disclosed in this document (in a similar manner to the aforementioned ThinPlug) is limited to applications where the earth pin is a dummy earth pin.

Another potential problem with this arrangement is that the hinge attaching the arm to the plug body is exposed during use it forms a point of mechanical weakness. Specifically, if the hinge were to fail whilst the plug was inserted in a socket (for example following an impact with the plug), then access could potentially be had to the live/neutral pins and/or to the fuse. In fact, investigations have tended to suggest that the inherent mechanical weaknesses of this design are such that the plug would only be able to pass the so-called "Barrel test" of British Standard 1363-1 if it were manufactured from specialist materials—the cost of which would render the plug economically unviable.

One other plug that has addressed the aforementioned thickness problem is marketed by a company called SlimPlug and is disclosed in GB2436465 and GB2417141. In general terms, the SlimPlug plug has pins that can pivot between a stowed position and a deployed position, and a button that a user can operate to release the pins, thereby enabling them to be rotated into or out of the plug main body. In this arrangement as access cannot be had to the pins when the plug is in a socket, the plug is suitable for applications where the earth is not a dummy pin, but provides an electrical connection to earth. However, whilst the plug with the pins retracted is significantly thinner than a conventional plug, it is still in the region of an inch thick—or in other words roughly twice as thick as an iPad.

Aspects of the arrangements described herein have been devised with the foregoing problems in mind.

SUMMARY

In accordance with a presently preferred arrangement, there is provided an electrical plug comprising: a plug main body; and a plurality of electrical pins, the pins being carried by an arm that is coupled to said plug main body and is rotatable relative thereto between a stowed position where the arm is generally linearly aligned with the plug main body, and a deployed position where the arm has rotated relative to the plug main body so as to be generally perpendicular thereto.

A principal advantage of this arrangement is that the inherent mechanical weakness of a hinged arm can be avoided. Furthermore, by having the electrical pins mounted on an arm that is rotatable relative to the main plug body, the overall size of the plug can be reduced as compared with the arrangement described in UK Patent No. 2381669 where the earth pin cannot be linearly aligned with the remaining pins.

Preferably, the arm is rotatable through 90 degrees or more relative to said plug main body. The arm may be rotatable through 360 degrees relative to said plug main body.

In one implementation the plug may comprise first and second wings that can be moved relative to said plug main body from a stowed position to a deployed position. The wings may be generally parallel to said plug main body when the wings are in said stowed position. The first and second wings may lie adjacent and abut said plug main body when the wings are in said stowed position. The first and second wings may extend, in said stowed position, to at least partly cover at least some of said plurality of electrical pins. The first and second wings may be generally perpendicular to said plug main body when said wings are in said deployed position.

In one implementation the wings may obstruct access to at least some of said electrical pins when said plug is plugged into a socket and said wings are in said deployed position.

In one arrangement the arm cannot be rotated from said stowed position without moving said wings to said deployed position.

The electrical plug may comprise a resilient bias configured to retain said arm in a predetermined position. The resilient bias may be configured to retain said arm in said deployed position. The plug main body may include a generally transverse channel in which said arm is retained by said resilient bias.

The arm may comprise a projecting peg, and said plug main body may comprise a socket configured to receive said peg. The projecting peg on said arm may be configured to snap-fit in said socket. The projecting peg may be held in said socket by a retainer. The retainer may comprise a circlip.

In another arrangement, the plug main body may comprise a projecting peg, and said arm may comprise a socket configured to receive said peg.

In another arrangement, said plug main body and said arm may be coupled together for relative rotation by a peg that is separate from both said plug main body and said arm.

The plug main body may include a transformer. The transformer may be configured to step down mains voltage to a lower voltage.

The plug main body may include a USB or other connector socket into which a USB or other connector can be plugged.

The plug main body may include a socket into which an electrical plug may be plugged. In one arrangement the socket is for electrical plugs with a different pin configuration.

In one implementation the electrical plug may function as both a voltage converter and a pin configuration converter.

The plug main body may carry one or more electrical pins that are fixed thereto.

The plug main body may carry a single fixed pin.

The fixed pin may comprise an earth pin that is configured to couple the plug and any appliance connected to the plug to earth when the plug is plugged into a mains socket.

In another arrangement, the fixed pin may comprise a dummy earth pin configured only to open protective gates within a mains socket into which the plug can be plugged.

In a preferred arrangement, the plug is capable of passing electrical signals when said arm is in said stowed position and said deployed position.

In one arrangement the plug may be configured to be mounted in a cooperating housing before being plugged into an electrical socket.

The cooperating housing may be coupled to a cable, and the housing may function as an electrical bridge between the electrical pins of said plug and wires of said cable.

Another aspect of the teachings of the invention provides a multi-plug adaptor and one or more electrical plugs as described herein, the adaptor comprising: a plurality of electrical pins arranged so that the adaptor can be plugged into an electrical socket for the supply of electrical power to the adaptor; and a plurality of adaptor sockets into one or more of which an electrical plug as described herein can be plugged, the adaptor including electrical connectors that are configured to electrically couple said electrical pins to each said adaptor socket for the supply of electrical power thereto.

In one arrangement, the adaptor sockets are configured for accepting electrical plugs that are in said stowed configuration.

The connector may comprise a plurality of electrical pins configured to mate with a said adaptor socket, and at least one socket for connection with a connector (such as a USB connector).

In another arrangement there is provided an electrical plug that comprises: a plug main body; an earth pin fixedly coupled to said plug main body; an arm pivotally attached to said plug main body for rotation relative thereto; a second electrical pin and a third electrical pin each coupled to said arm for rotation therewith relative to said plug main body; and first and second wings pivotally mounted to said plug main body for movement relative thereto between a first stowed position and a second deployed position.

Another arrangement provides an electrical plug that comprises: a plug main body, and first and second wings pivotally attached to said plug main body for movement relative thereto; said wings being moveable between a first position where the wings extend generally in parallel to said plug main body and a second position where the wings extend generally perpendicularly from said plug main body.

Yet another arrangement provides an electrical plug comprising: a plug main body; and electrical pins carried by an arm that is rotatable relative to said plug main body between a stowed position where the pins are generally linearly aligned with the plug main body, and a deployed position where the arm has moved relative to the plug main body so that the pins are generally perpendicular to the plug main body to thereby enable the plug to be inserted into a mains electrical socket with which the plug co-operates.

Another arrangement relates to a reconfigurable electrical plug that comprises: a plug main body and a number of electrical pins, the pins being moveable relative to said plug main body between a stowed storage configuration and a deployed in-use configuration, the arrangement being such that in said stowed configuration the size of the plug is reduced relative to the size of the plug in said deployed configuration.

Yet another arrangement provides an electrical plug assembly that comprises: a plug main body that carries a plurality of electrical pins; and a housing with which the plug main body cooperates, the housing being configured to define a storage chamber in which the plug main body can be at least partly received, and to provides access to a plurality of openings in the housing, each said opening being configured to receive a said electrical pin of said plurality, wherein said assembly can be reconfigured between a storage configuration in which the plug main body is at least partly received in the storage chamber, and an operative configuration where the pins carried by the plug main body have been pushed through the openings so that the pins project from the housing for insertion into a socket, the housing including means for electrically coupling the pins that have been pushed through said openings and inserted into a said socket to an appliance that is connected to the housing.

Other arrangements and embodiments, and advantages and features thereof, will become apparent from the following detailed description.

BRIEF DESCRIPTION OF THE DRAWINGS

Various aspects of the teachings of the present invention, and arrangements embodying those teachings, will hereafter be described by way of illustrative example with reference to the accompanying drawings, in which.

DETAILED DESCRIPTION

Referring now to FIGS. 1 to 4 of the accompanying drawings, there are depicted a schematic front perspective view, a schematic side elevation, a top plan view and an exploded view (respectively) of a plug 1 that embodies the teachings of the present invention.

Figure 1:
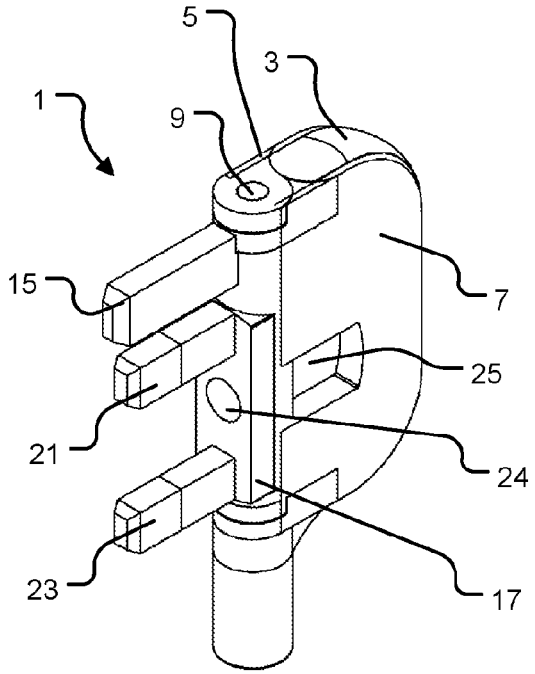
FIG. 1 is a schematic front perspective view of a plug embodying the teachings of the invention.

The plug 1 comprises a plug main body 3 and first and second wings 5, 7. The wings are mounted on the plug main body for rotation relative thereto by means of upper 9 and lower 11 pivot pins which engage with corresponding pivot sockets (only one 13 of which is visible) in the plug main body 3. The wings 5, 7 can be pivoted, as will later be described, about the aforementioned pivot pins 9, 11 from a stowed position as depicted in FIG. 1 where the first and second wings are generally adjacent one another and extend generally in parallel to the plug main body 3, to a deployed position (shown in FIGS. 7 and 8) where the wings are linearly aligned and extend generally perpendicularly to the plug main body 3.

A first pin 15 extends generally perpendicularly from the plug main body 3. The first electrical pin 15 may be of an electrically conductive material and function to electrically couple an appliance to earth. Alternatively, the first pin 15 may be of an electrically insulating material and merely comprise a dummy earth pin that functions only to open the socket safety gates that obstruct access to the live and neutral circuits. The plug main body 3 also includes a socket 10 for receiving a fuse 14 (FIG. 4), which socket can be closed by fuse plug 12.

The plug 1 further comprises an arm 17 that is mounted for rotation on the plug main body 3 about a peg that functions as a pivot point 19. The arm carries a second electrical pin 21 and a third electrical pin 23 that extend, as shown, generally perpendicularly from the arm 17 and hence from the plug main body 3. In this particular arrangement the second 21 and third 23 electrical pins are coupled to respective electrical connectors (not visible) on the underside of the arm 17—i.e. the side closest to the plug main body 3 when the arm is fitted thereto. These electrical connectors are configured to electrically connect with respective electrical contacts 19*a*, 19*b* (FIG. 4) that project from the plug main body 3 to either side of pivot point 19.

The peg that forms pivot point 19 and the arm 17 are each configured so that the arm can be snap-fitted onto the peg. Once the arm 17 has been fitted onto the peg, a cap 24 can be fitted into the aperture in the arm 17 to shut off access to the peg.

As will later be described in detail, the plug is configured so that if the arm 17 is orientated so that the second pin 21 functions as the live pin (that is to say a pin which electrically connects an appliance to the live electrical supply via a fuse (received in fuse socket 10)), then the third pin 23 functions as the neutral pin (that is to say a pin which electrically connects an application to the neutral electrical supply), and vice versa.

Figure 2:
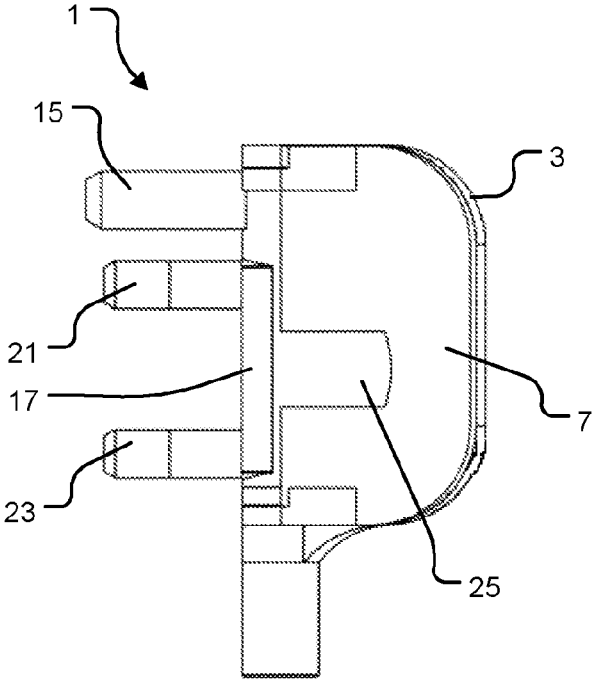
FIG. 2 is a side elevation of the plug depicted in FIG. 1.
Figure 3:
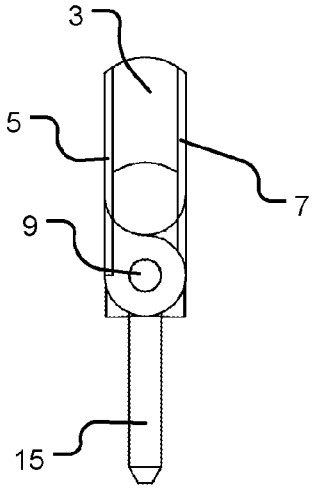
FIG. 3 is a top plan view of the plug depicted in FIG. 1.
Figure 4:
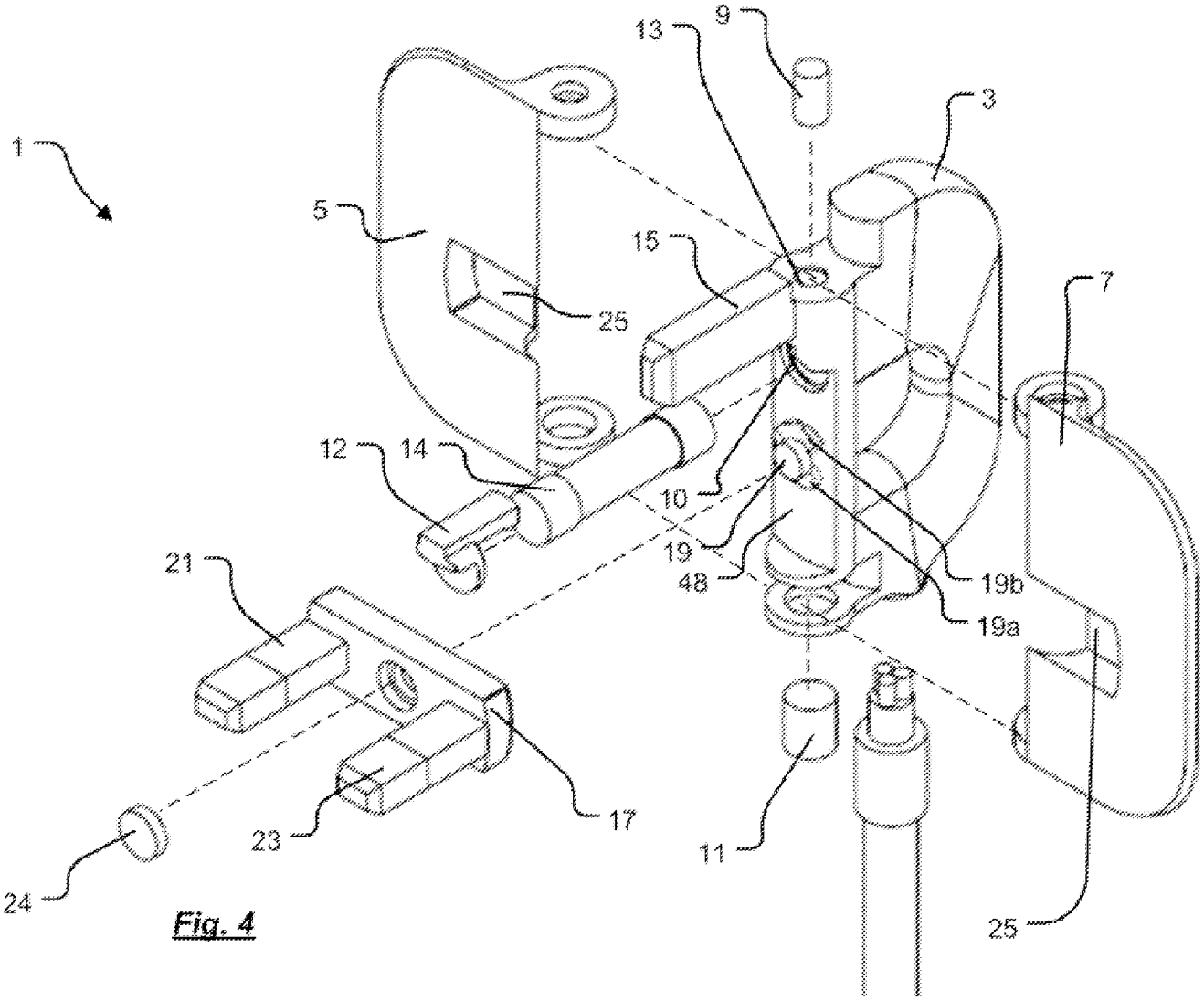
FIG. 4 is an illustrative exploded view of the plug depicted in FIG. 1.
Figure 7:
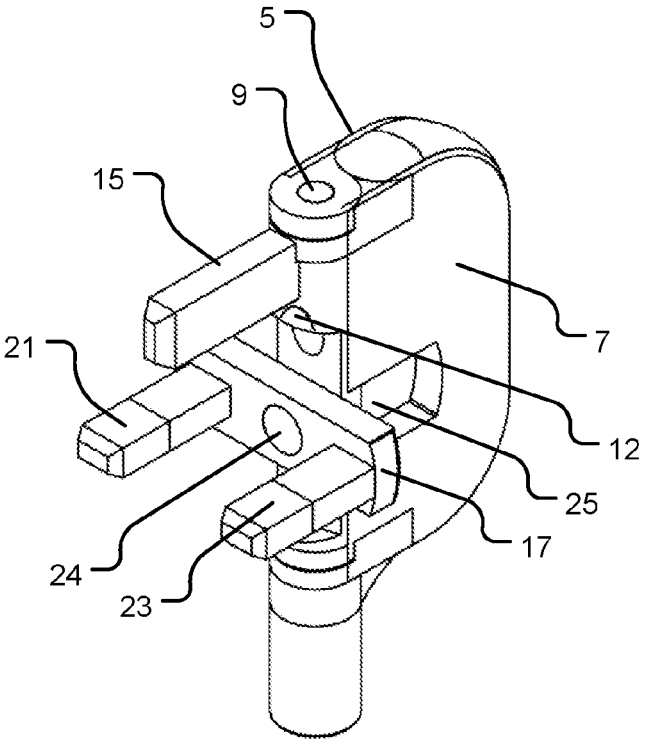
FIG. 7 is a schematic front perspective view of the plug in FIG. 1 with wings stowed and arm rotated.

As shown in FIG. 4, the wings 7, 9 each include a depression 25 that accommodate the arm 17 when the arm has been rotated by 90 degrees to a deployed position (i.e. a position where the arm is generally perpendicular to the plug main body) from the stowed position (i.e. a position where the arm is generally parallel to the plug main body) depicted in FIGS. 1 and 2, and the wings 5, 7 have been extended to the deployed position shown in FIG. 7.

Figure 5:
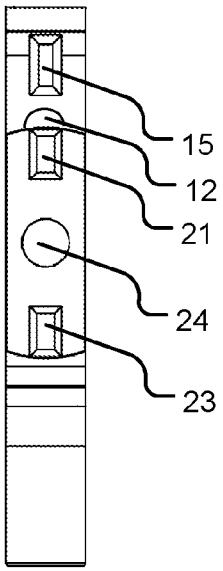
FIGS. 5 and 6 are front and rear elevations, respectively, of the plug depicted in FIG. 1.
Figure 6:
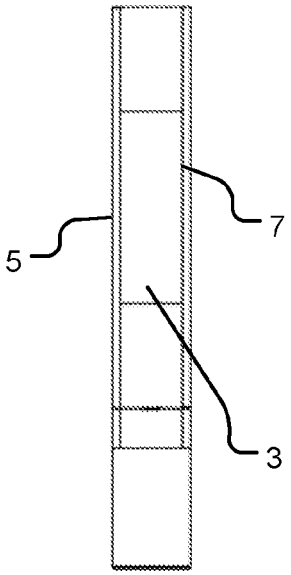
Figure 8:
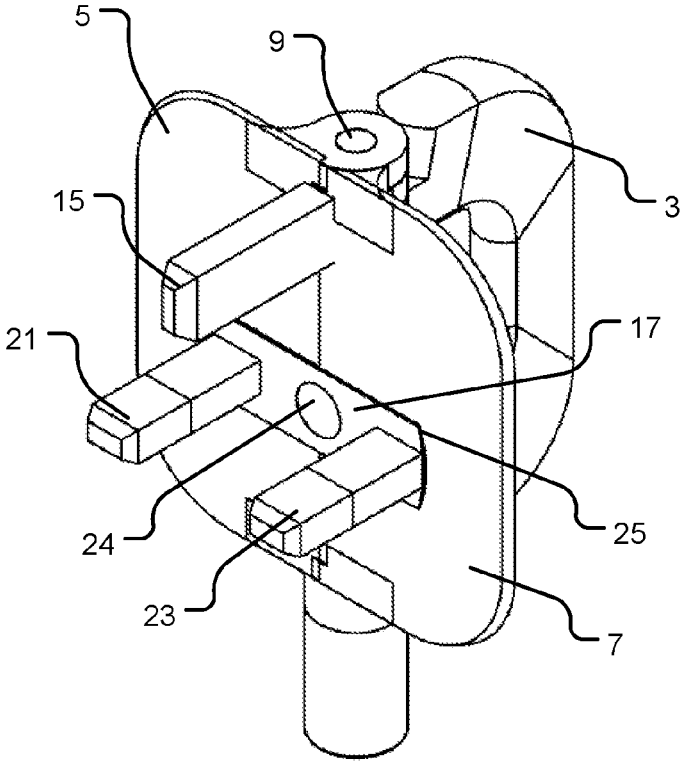
FIGS. 8 and 9 are schematic front perspective and left elevation views, respectively, of the plug depicted in FIG. 6 with wings deployed.

As can be seen from FIGS. 5 and 6, in particular, the plug 1 of this arrangement is particularly compact when arranged in the stowed position with the wings 5, 7 extending in parallel to the plug main body 3. In a departure from many plugs of this type (that is to say, plugs that have been developed to be of reduced size—at least in comparison to a traditional three pin UK plug), the plug 1 is capable of functioning when the arm and wings are in the stowed configuration (shown in FIG. 1) as well as when the plug is in the deployed configuration (FIG. 8). Details of how this functionality is achieved will later be provided.

The plug main body, as will later be described, houses wiring and other internal components of the plug. An earth pin support 48 (FIG. 4), a back plate 29 (FIG. 10), and a cover plate (not shown) cooperate to form the plug main body 3.

Referring now to FIG. 7, there is depicted a schematic front perspective view of the plug in FIG. 1 with wings stowed and arm 17 rotated (deployed). As shown, the fuse plug 12 is only accessible when the arm 17 has been rotated out of alignment with the plug main body 3 to the deployed position, and the advantage of this arrangement is that the fuse plug 12 cannot be extracted (to give access to the fuse) when the plug is plugged into a socket.

Figure 9:
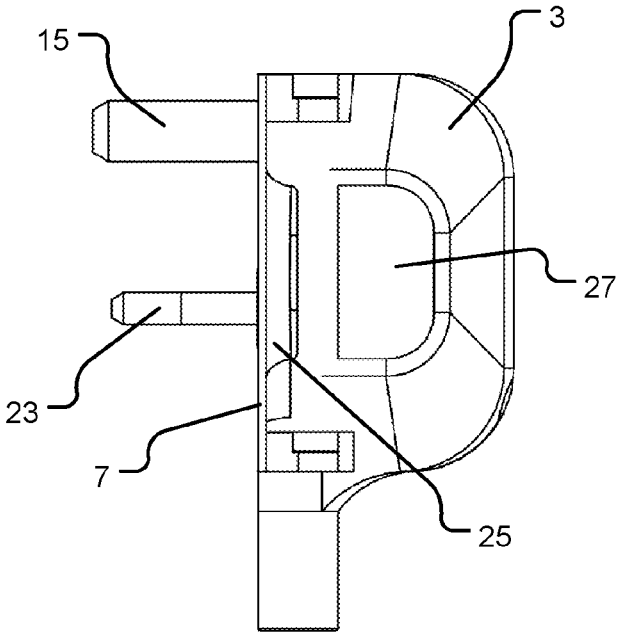

To go from the stowed position shown in FIGS. 1 to 6 to the operative position shown in FIGS. 8 and 9, the user must first rotate the arm 17 via the pivot pin 19 until the arm is generally perpendicular to the plug main body 3 and the pins 15, 21, 23 are arranged in a triangle (as shown in FIG. 7). When the plug is in this configuration, the wings 5, 7 can be folded from the stowed position where they lie generally parallel to the plug main body 3 to a deployed position where the wings are linearly aligned and extend perpendicularly from either side of the plug main body 3 (as shown in FIG. 8). In this configuration, the plug 1 is now ready to be plugged into a suitable socket In an envisaged implementation of the invention, a lock (not shown) may be provided that can be operated to lock the wings 5, 7 in the deployed position shown in FIG. 8. In a particularly preferred arrangement, the lock may be configured so that the supply of electrical power from one or more of the pins 21, 23 is interrupted until the lock has been operated to hold the wings in the deployed position.

In an illustrative arrangement, the lock may comprise a slider built into the side of the plug main body that includes a peg which projects inside the main body of the plug 1 to operate a switch within the plug. In this arrangement the slider may be movable from an inoperative position where the wings 5, 7 can moved between the stowed and deployed positions and electrical power from one or more of the pins 21, 23 is interrupted, to an operative position where the wings cannot be retracted from the deployed position and electrical power is allowed to flow from the switched pin or pins. In a particularly preferred arrangement, the lock is only accessible when the wings are in the deployed position shown in FIG. 8.

As shown in FIG. 9, in one illustrative configuration the plug main body includes an aperture or recess 27 in which the wing depressions 25 locate when the wings 5, 7 are in the stowed position. An advantage of this configuration is that the aperture/recess 27 provides an easy means for a user to grip the plug to facilitate its extraction from a socket. If the plug main body 3 includes an aperture 27, then the user can insert their finger through the aperture 27 and pull the plug from the socket.

Figure 10:
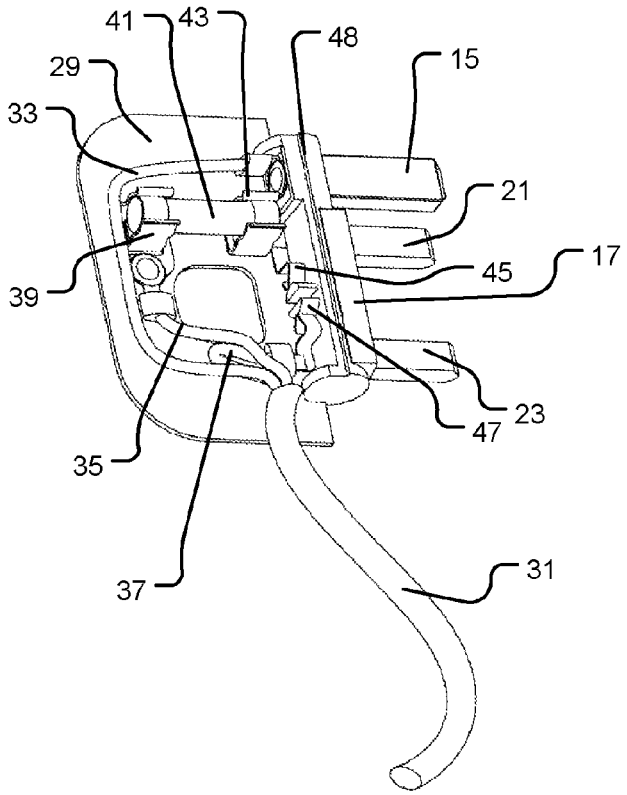
FIGS. 10 and 11 are rear perspective and right side elevations, respectively, of the plug internals depicting an illustrative wiring scheme.
Figure 11:
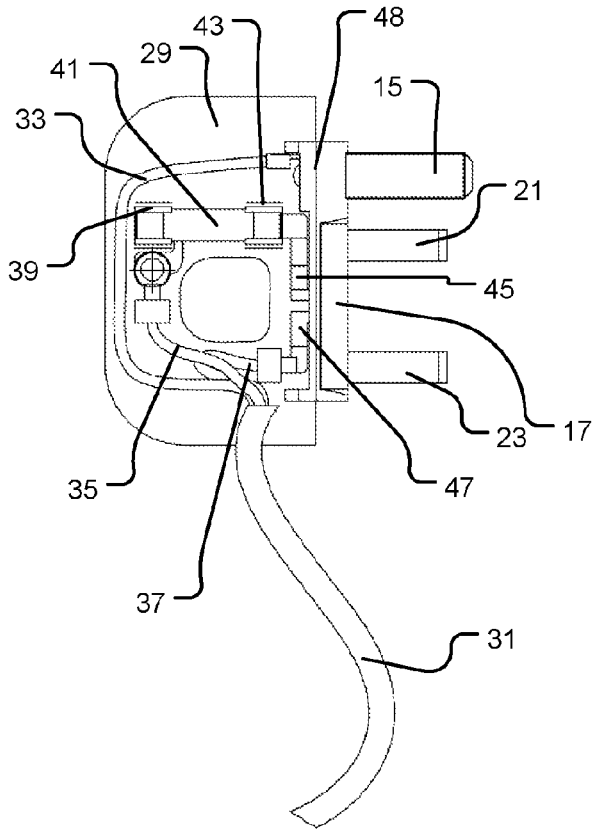

FIGS. 10 and 11 are rear perspective and right side elevations, respectively, of the inside of the plug main body 3 depicting an illustrative wiring scheme for the plug depicted in FIGS. 1 to 9.

As aforementioned, the plug main body 3 comprises the pin support 48, the cover section (not shown) and the back plate 29 to which internal components of the plug are coupled. The plug is coupled to an appliance (not shown) by a cable 31 (in this instance a three-core cable) that terminates inside the plug main body and includes an earth wire 33, a live wire 35 and a neutral wire 37.

The earth wire is crimped, or otherwise affixed, at one end to the earth pin 15. The live wire 35 terminates at the first 39 of a pair of brackets which are coupled to the back plate 29 and are designed to hold a fuse 41. The other 43 of said pair of brackets is coupled to a first connector 45 that extends through the pin support 48 to from electrical contact 19*b* (see FIG. 4), which contact makes an electrical connection with an electrical contact that is coupled to one of said second and third pins 21, 23 and is accessible from the underside of the arm 17. The neutral wire 37 terminates at a second connector 47 which extends through the pin support 48 to form electrical contact 19*a* (see FIG. 4), which contact makes an electrical connection with an electrical contact that is coupled to the other of said second and third pins 21, 23 and is also accessible for the underside of the arm 17.

Figure 12:
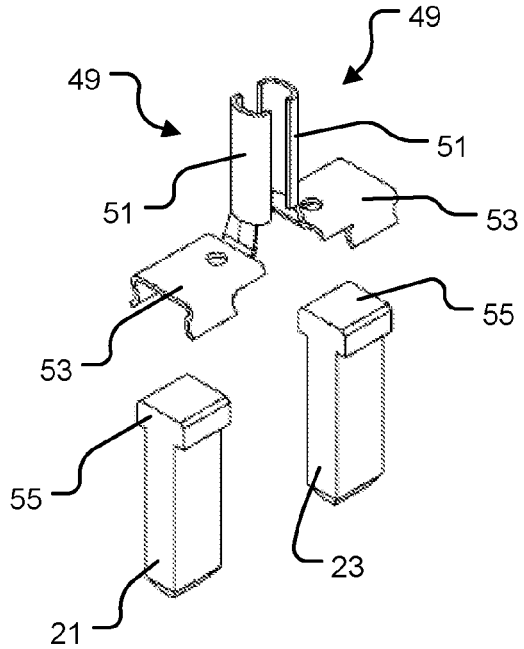
FIG. 12 is a schematic representation of an illustrative pin assembly.

FIG. 12 is a schematic representation of another illustrative pin assembly, in particular an assembly of the second and third pins 21, 23 and respective electrical contacts 49. Each electrical contact 49 comprises a curved portion 51 that is coupled to a socket portion 53. The socket portions are configured to couple the electrical contacts to enlarged tail portions 55 of each of respective pins 21, 23. In this particular arrangement the pins 21, 23 can be push fitted into respective socket portions 53 to securely couple respective pins to respective electrical contacts. In other arrangements the pins could be crimped or welded to respective socket portions.

As shown in FIG. 12, the curved portions 51 are configured to extend through less than 180 degrees, for example 160 degrees, so that diametrically opposite live and neutral electrical contacts (such as contacts 45, 47; FIGS. 10 and 11) cannot both touch the same curved portion at the same time.

Figure 13:
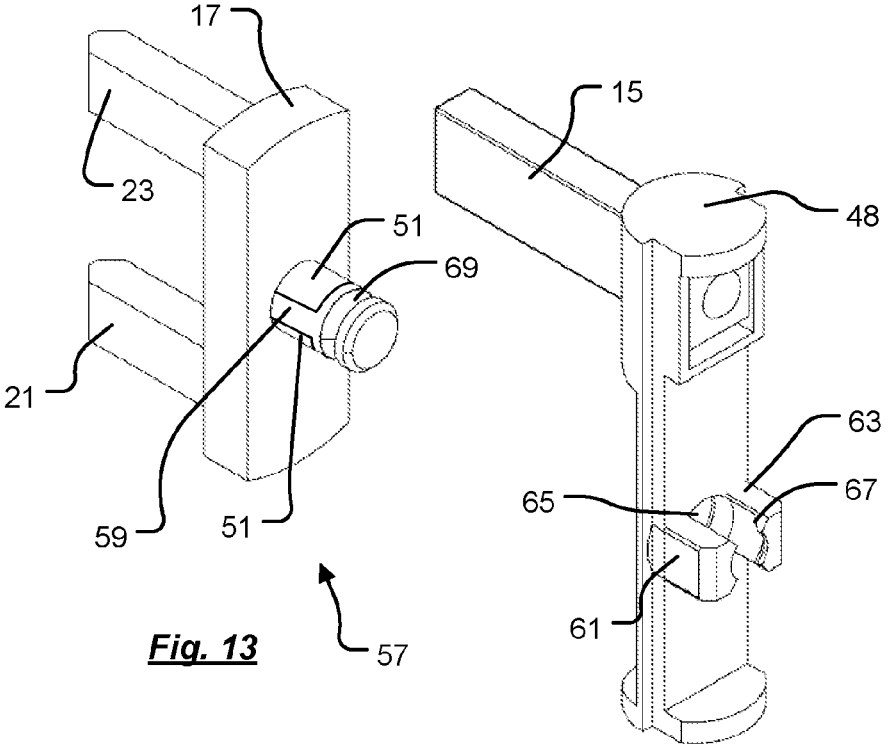
FIG. 13 is an exploded view of an over-moulded pin assembly and a pin support with which the pin assembly co-operates.

Referring now to FIG. 13, once the pins 21, 23 have been—in this embodiment—push fitted into respective socket portions, the pins and contacts 49 are assembled in a mould and then over-moulded (for example with a plastics material) to form an over-moulded pin assembly 57 that includes the arm 17 that carries the pins 21, 23. The curved portions 51 of each electrical contact project from the arm 17 and each extend partway about the peripheral circumference of a mounting peg 59 that is integrally formed with the arm 17.

As will be appreciated, the principal difference between the pin assembly of this arrangement and that of preceding arrangements is that in this arrangement the arm 17 carries a member that fits within the plug main body, whereas in preceding arrangements the arm fitted onto a member that forms part of the plug main body.

Figure 14:
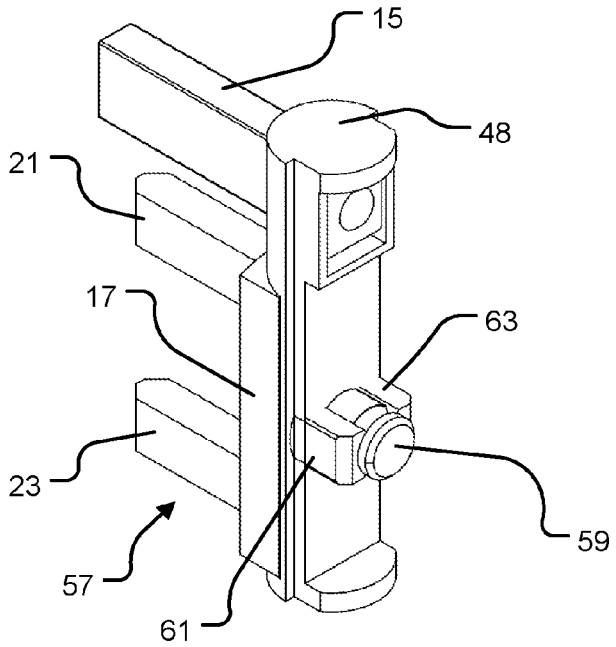
FIG. 14 shows the components of FIG. 13 assembled together.

The earth pin support 48 comprises first and second connectors 61, 63 that are formed at diametrically opposite points about the edge of a through-hole 65. Each connector comprises a lip 67 that projects inwardly towards the through-hole 65, and the connectors are configured to elastically and outwardly deform as the peg 59 is pushed into the through-hole until the projecting lip of each connector locates in a circumferential groove 69 formed in an end of the peg 59 distal from the pins 21. As shown in FIG. 14, when the projecting lip 65 of each connector 61, 63 locates in the groove 67, the arm 17 (and hence the over-moulded pin assembly 57) is securely coupled to the earth pin support 48, and is rotatable relative thereto.

Figure 14A:
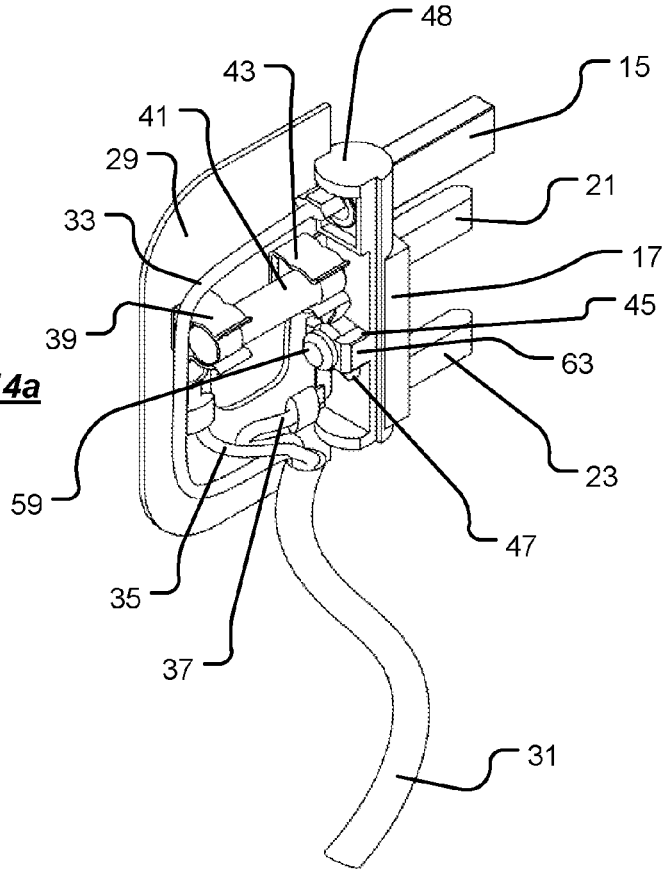
FIGS. 14*a* and 14*b* are rear perspective and right side elevations, respectively, of the plug internals depicting another illustrative wiring scheme.
Figure 14B:
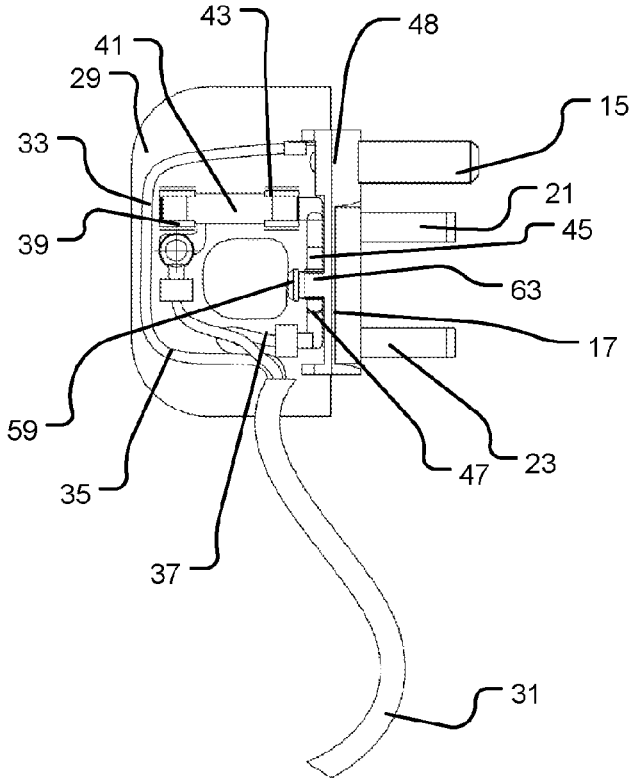

FIGS. 14*a* and 14*b* are illustrative rear perspective and side elevation views of an illustrative wiring scheme that includes the pin support 48 and pin assembly of FIGS. 12 to 14. In this arrangement the first 45 and second 47 connectors comprise spring contacts that can bear against respective curved portions 51 of electrical connections 49.

Figure 15:
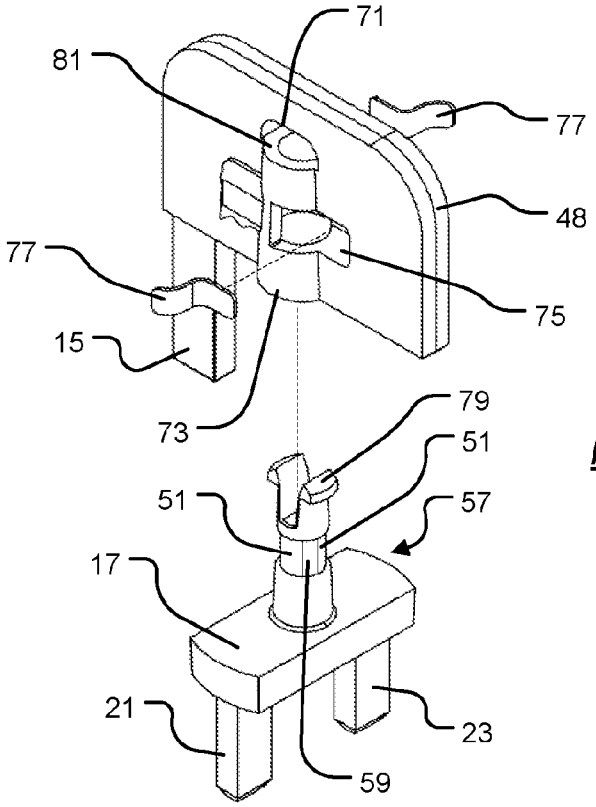
FIG. 15 is an exploded view of another illustrative support and pin assembly.

An exploded view of another illustrative pin assembly and support is shown in FIG. 15. In this arrangement the support 48 for the earth pin 15 has a cut-away portion 71 that includes a hollow cylinder 73. The support further comprises a pair of windows 75, one on either side of the support (n.b. only one window is visible in FIG. 15) into which respective electrical spring contacts 77 may be fitted. The windows provide access to the hollow interior of the cylinder 73 and enable the electrical contacts 77 to make contact with the curved portions 51 of the electrical contacts of the pin assembly 57.

Figure 16:
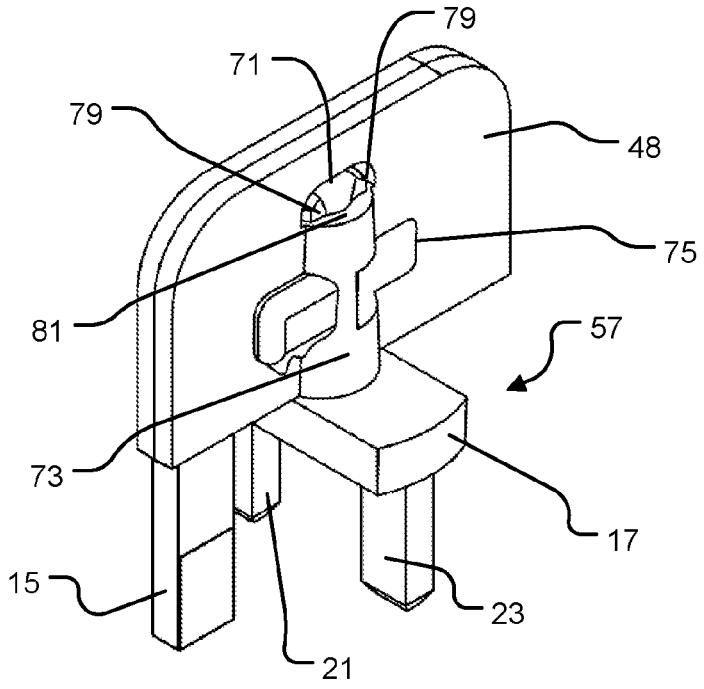
FIGS. 16 and 17 are top and bottom perspective views, respectively, of the components of FIG. 15 assembled together.
Figure 17:
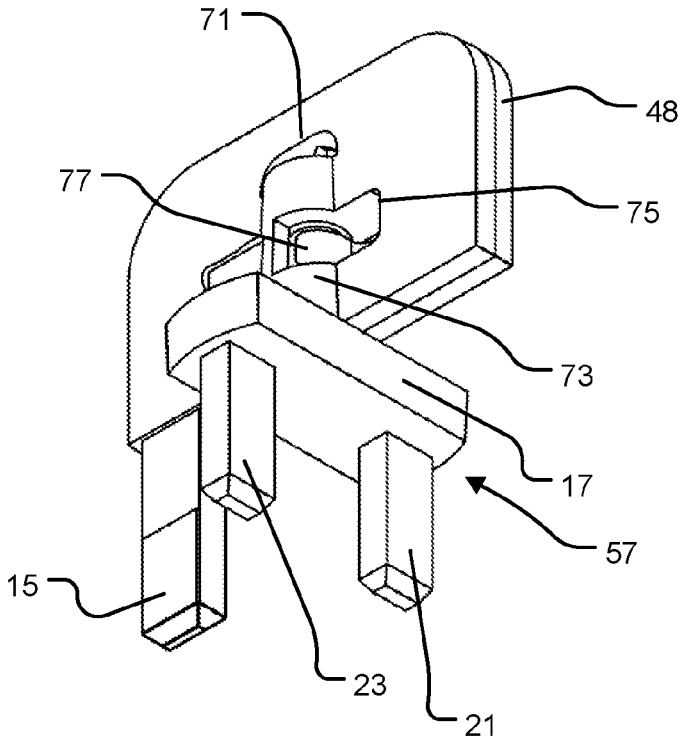

As shown in FIG. 15, the peg 59 of this arrangement includes a pair of outwardly barbed tabs 79 that flex inwardly as the pin assembly 57 is pushed into the hollow cylinder 73 of the pin support. As the pin assembly is pushed through the cylinder 73, the tabs 79 latch over a top edge 81 of the cylinder (as shown in FIG. 16) to securely couple the pin assembly 57 to the pin support 48. As shown in FIGS. 16 and 17, once assemble the pin assembly 57 is securely coupled to the pin support 48, and rotatable relative thereto.

Figure 18:
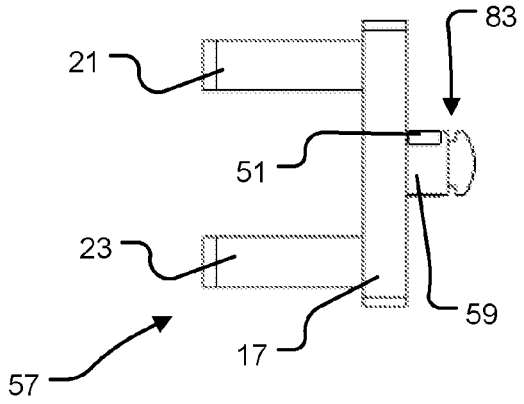
FIGS. 18 to 20 are schematic views of a third arrangement of pin support and pin assembly.
Figure 19:
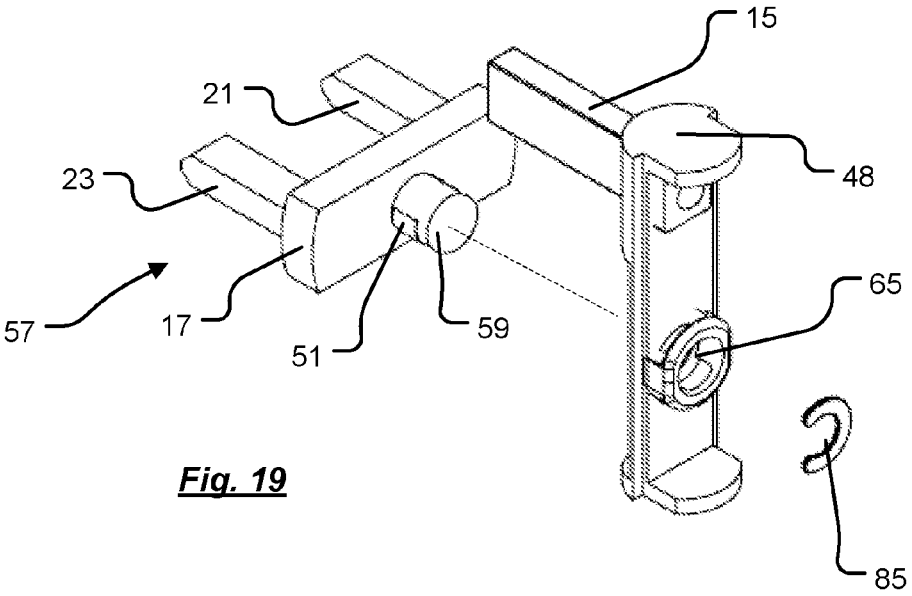
Figure 20:
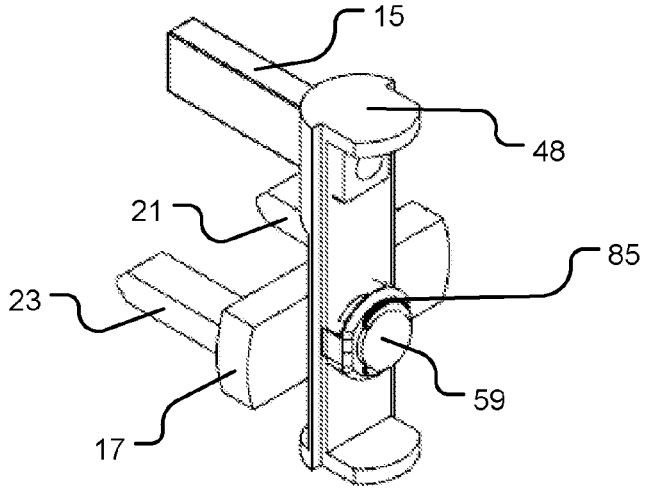

FIGS. 18 to 20 are schematic representations of a third arrangement of pin support and pin assembly. As shown in FIG. 18, in this arrangement the distal end of the peg 59 of the pin assembly 57 comprises a circumferential groove 83. As shown in FIGS. 19 and 20, a generally C-shaped split washer 85 (otherwise known as a circlip) can be slid into the groove 83, once the peg 59 of the pin assembly 57 has been pushed through the aperture 65 in the pin support 48, to securely couple the pin assembly 57 to the pin support 48 whilst still allowing the pin assembly 57 to rotate relative to the support 48.

Figure 20A:
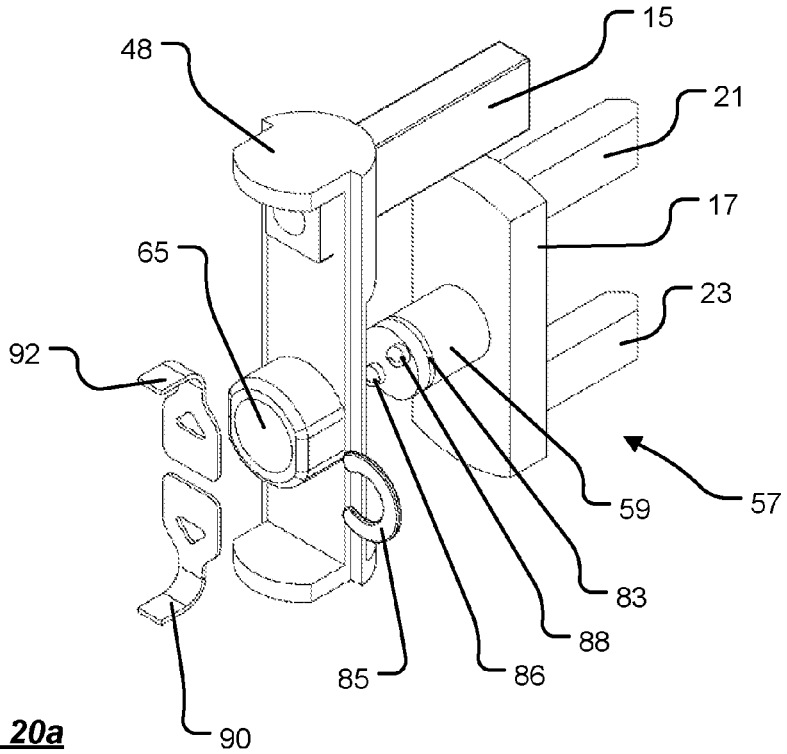
FIGS. 20*a* and 20*b* are exploded and assembled perspective views, respectively, of a modification of the arrangement shown in FIGS. 18 to 20.
Figure 20B:
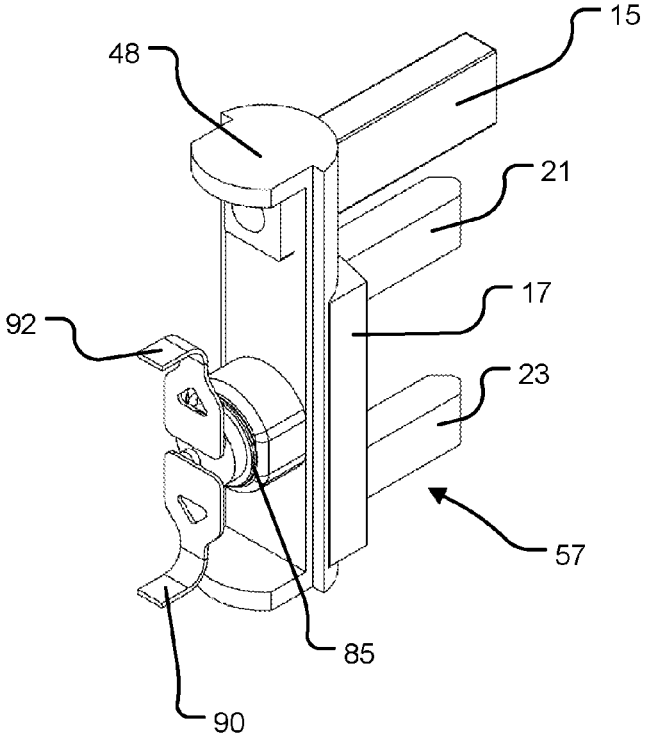

FIGS. 20*a* and 20*b* depict a modification of the arrangement shown in FIGS. 18 to 20. Specifically, in this arrangement the electrical contacts 49 of the FIG. 18 arrangement are embedded within the peg and extend from an end of the peg 59 distal from pins 21, 23 to form electrical contacts 86, 88. Electrical contacts 86, 88 can electrically couple with contacts 90, 92 within the plug main body 3 when the pin assembly 57 is secured to the pin support 48 by the circlip 85.

Figure 21:
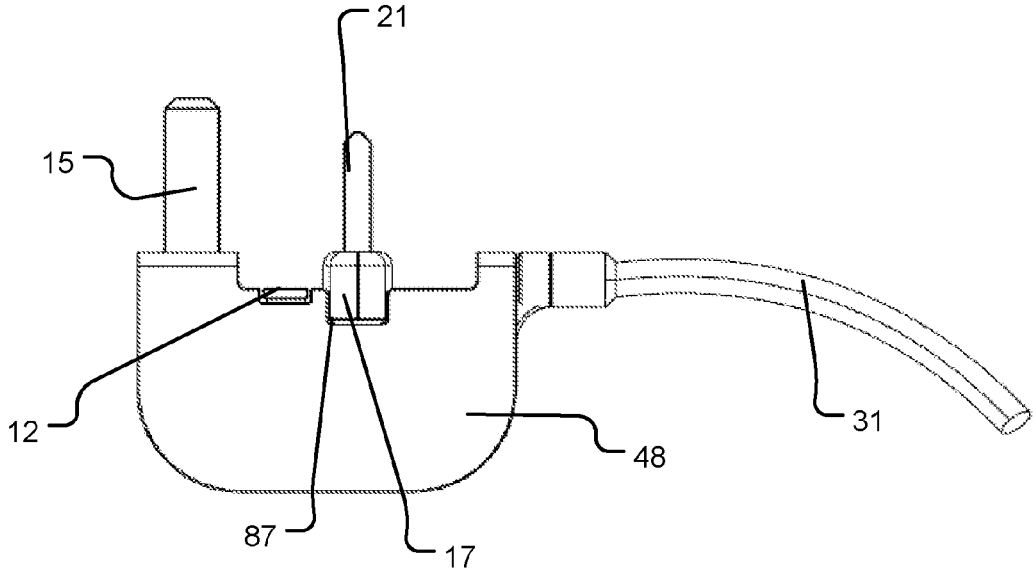
FIGS. 21 and 22 depict another illustrative plug configuration.
Figure 22:
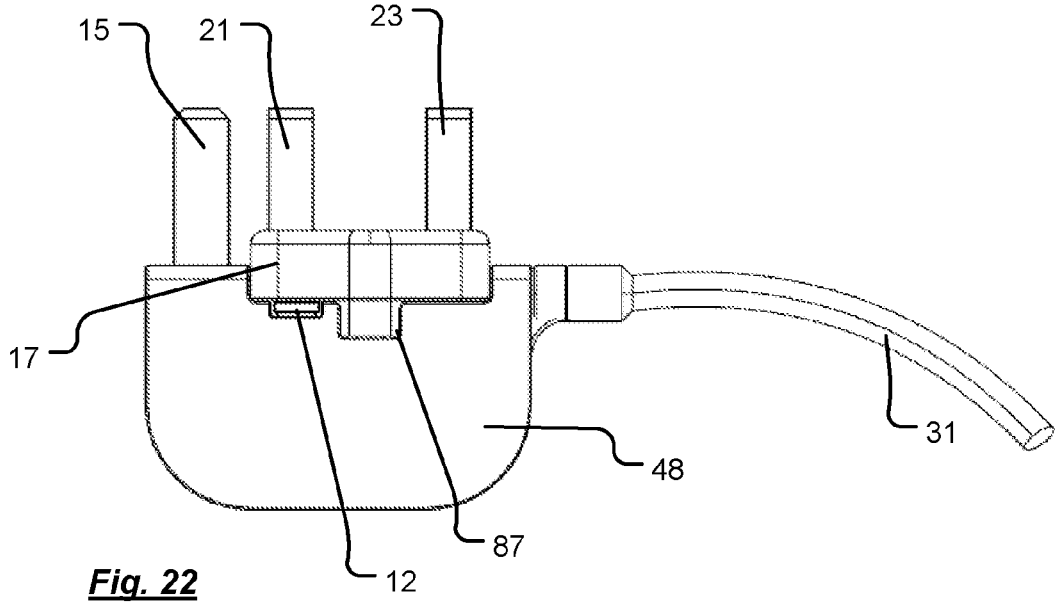

FIGS. 21 and 22 depict another illustrative plug configuration (from which the wings have been removed for clarity of display). In this configuration a spring or other resilient bias is provided within the pin support 48, and functions to drive the arm 17 into a groove 87 formed in the pin support 48. The advantage of this arrangement is that when the arm 17 is perpendicular to the pin support 48 (as shown in FIG. 21) it is retained in position by the resilient bias and difficult to inadvertently move out of position. To move the arm from a position where the arm 17 is perpendicular to the pin support 48, one must pull the arm away from the pin support 48 against the resilient bias before the arm 17 can be rotated relative to the pin support 48.

FIGS. 23 to 26 are, respectively, front perspective, right side elevation, top plan and bottom plan schematic representations of another plug 100 that embodies the teachings of the invention.

The plug 100 of this arrangement is similar in many respects to that depicted in FIG. 1. The chief difference is that in this arrangement the plug 100 comprises first 102 and second 104 wings that extend towards the pins when the plug is in the stowed configuration. A principal advantage of this arrangement is that as the wings cover much of the pins 15, 21, 23, there is less chance of the pins coming into contact with (and potentially damaging) anything else being carried. The wings also protect the pins when the plug is in the stowed configuration.

A less significant difference is that the aperture 27 of the plug shown in FIGS. 1 to 9 has been replaced, in this plug configuration, by a grippable portion 106 that might comprise, for example, a section of ridged rubber material.

Figure 23:
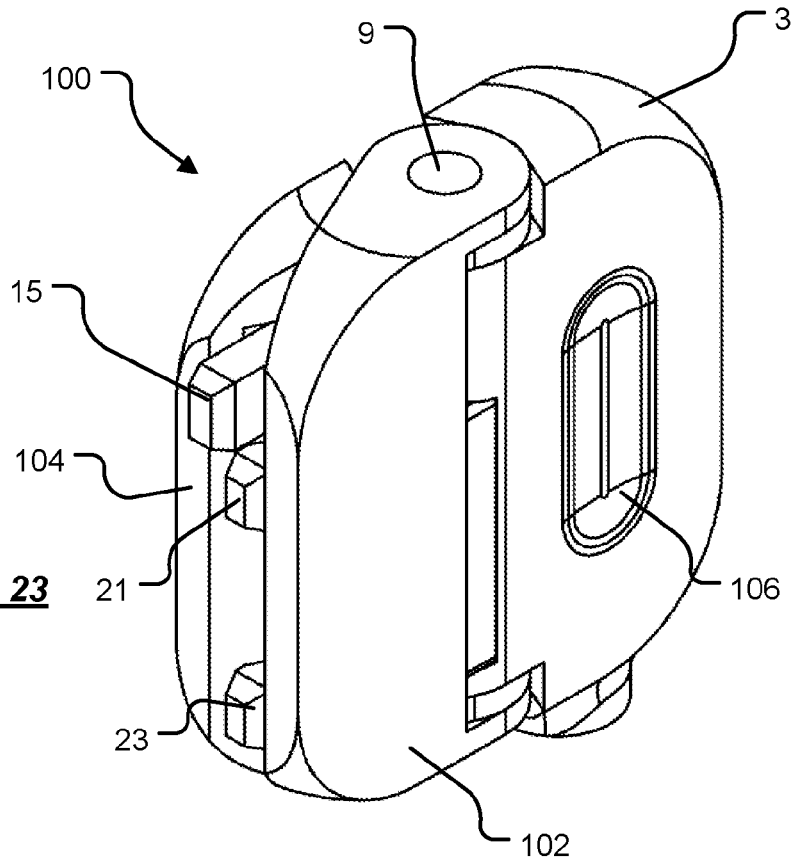
FIG. 23 is a front perspective view of another plug that embodies the teachings of the invention.
Figure 25:
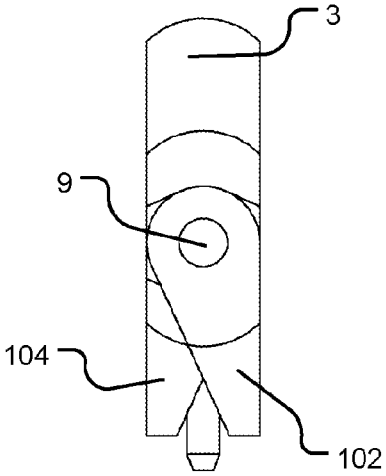
FIGS. 25 and 26 are top and bottom plan views, respectively, of the plug shown in FIG. 23.
Figure 26:
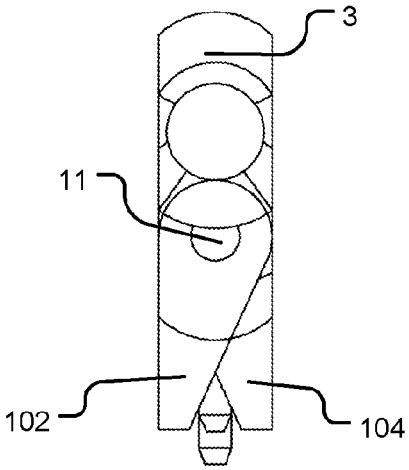

As with the arrangement shown in FIG. 1, the wings 102, 104 of this arrangement are coupled to the plug main body 3 for rotation relative thereto by means of upper and lower pivot pins (the upper pivot pin 9 being visible in FIGS. 23 and 25, the lower 11 being visible in FIG. 26).

Figure 24:
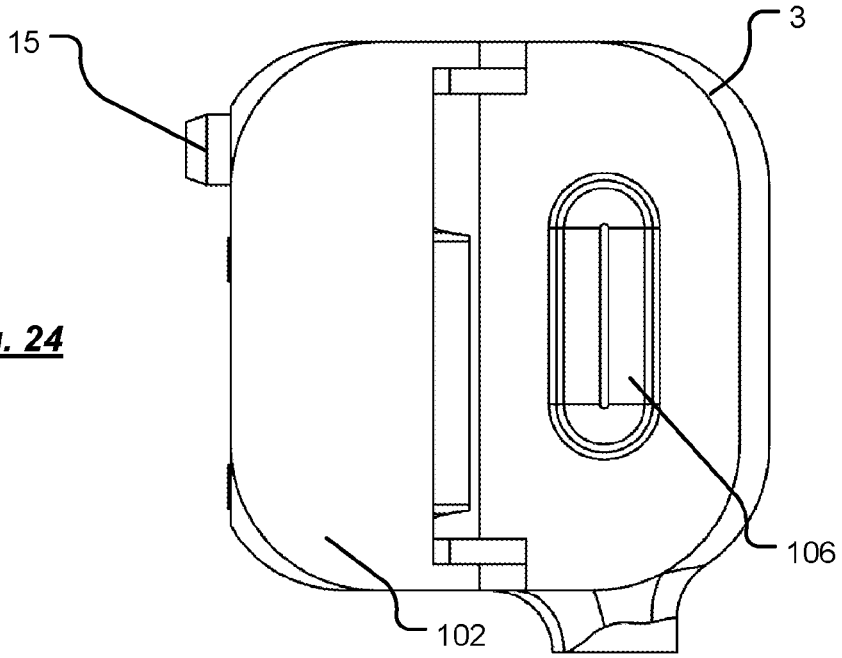
FIG. 24 is a right side elevation of the plug shown in FIG. 23.
Figure 27:
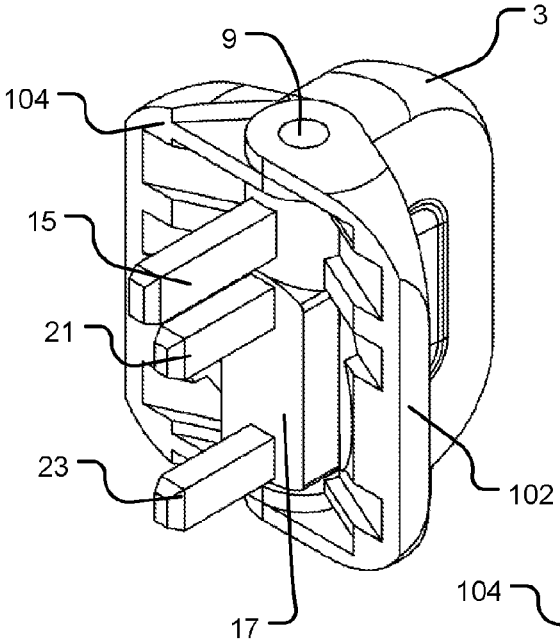
FIGS. 27 and 28 are front perspective views of the plug shown in FIG. 23 in different operative states.
Figure 28:
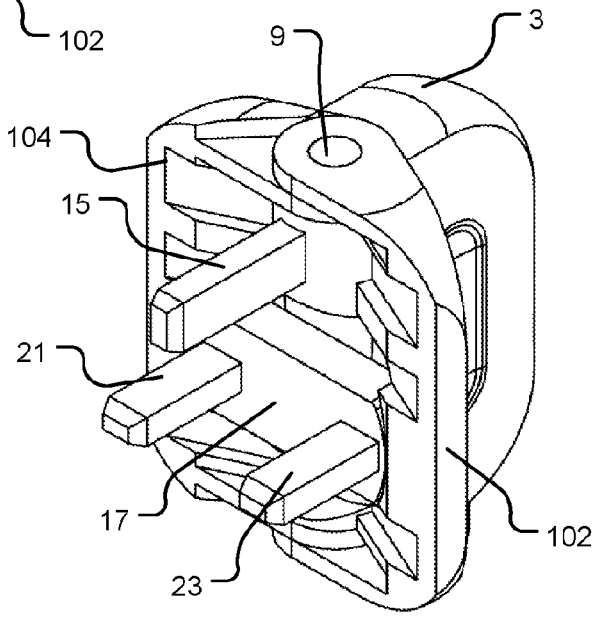

FIG. 27 shows the plug 100 with wings 102, 104 extended from the stowed position depicted in FIGS. 23 and 24. The arm 17 has yet to be rotated, however, and as such the second and third pins 23, 25 and still linearly aligned with the earth pin. To enable the plug to be inserted into a socket, the arm 17 must be rotated to the position shown in FIG. 28 where the pins 15, 21 and 23 form a triangle. In this configuration the plug can be plugged into a socket, and the wings prevent access from being had to the pins of the plug whilst it is inserted into the socket.

The plug shown in FIGS. 23 to 28 may be used with a three-core cable (not shown) and in such a configuration the earth pin 15 would function to electrically connect an appliance to which the plug is coupled to earth. The wiring of such a configuration would be similar, if not identical, to that shown in FIGS. 10 and 11.

Figure 29:
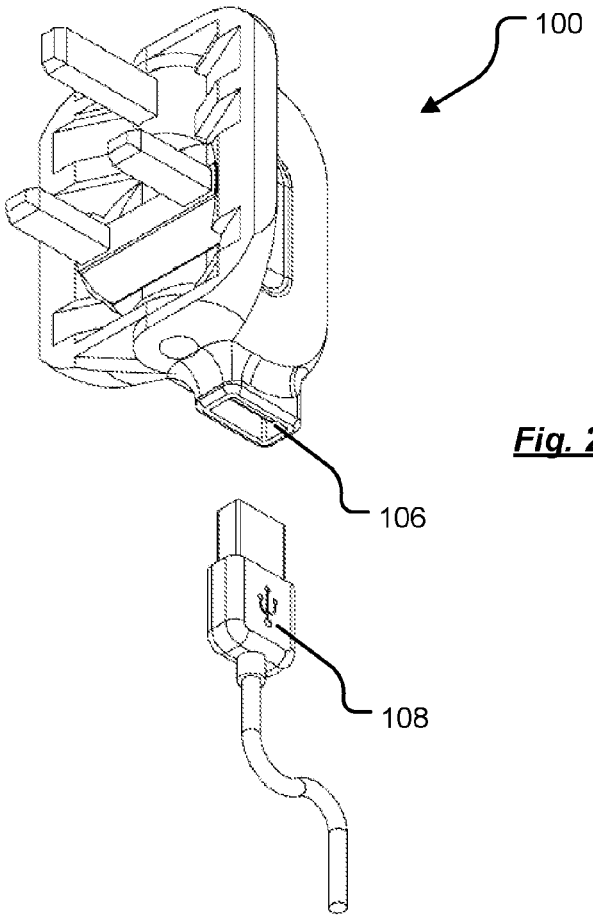
FIGS. 29 and 30 are schematic views of a plug that is configured for attachment to a universal serial bus (USB) adaptor.
Figure 30:
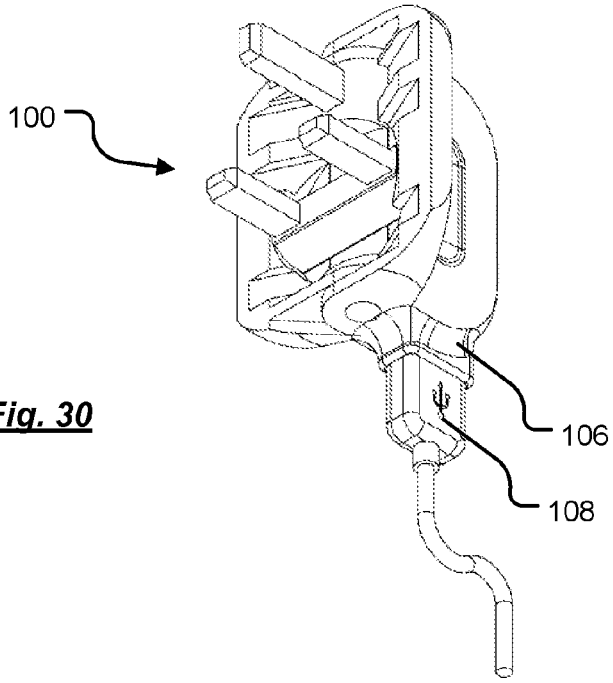

In another contemplated arrangement, the plug of FIGS. 23 to 28 may include, as depicted in FIGS. 29 and 30 a socket 106 for a universal serial bus (USB) connector 108. In this configuration the plug main body 3 includes a transformer (not shown) that is configured to step down mains voltage (which in the UK is about 240 V) to a USB compatible voltage (for example to 5 or 9 Volts). In such a configuration, since the electrical output is essentially "low voltage", there is no need to connect the appliance in question to earth. As a consequence, the cable leading from the USB connector 108 can be a two-core earthless cable. Furthermore, as there is no need for a fuse in such a configuration, there is plenty of room inside the plug main body 3 for housing a suitable transformer.

Figure 31:
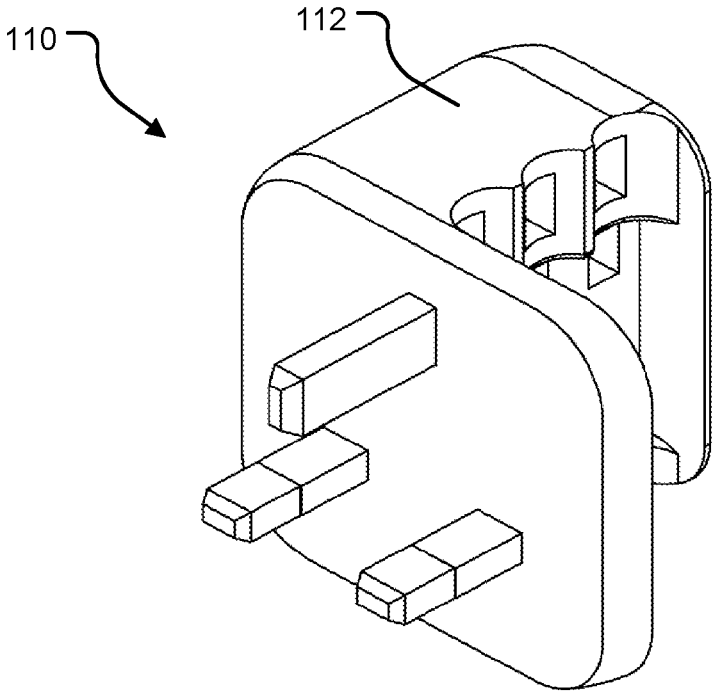
FIGS. 31 and 32 are front right and rear right perspective views, respectively, of a multi-plug adapter for use with the plugs described herein.
Figure 32:
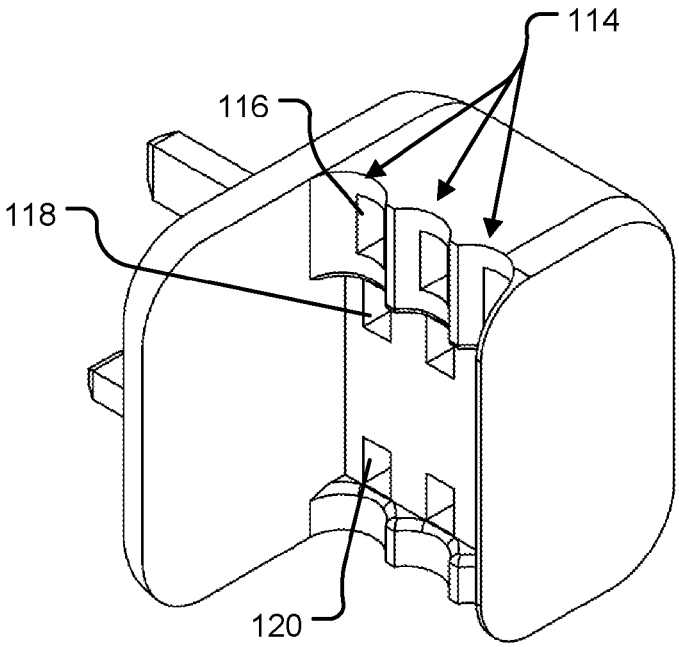

FIGS. 31 and 32 are front right and rear right perspective views, respectively, of a multi-plug adapter 110 for use with the plugs described herein (in particular the plug depicted in FIG. 1).

The multi-plug adaptor 110 is configured for use with UK sockets and to that end it comprises a front face from which three pins project. It will be apparent, however, that the adaptor could equally be configured for use with non-UK sockets, and in such circumstances a fewer or greater number of pins may project from the front face of the adaptor. For example, for use in other European countries the multi-plug adaptor may only have two pins The adaptor comprises a main body 112 that includes three discrete sockets 114. Each socket 114 is configured so that a plug of the type depicted in FIG. 1 can be plugged into the socket when the plug is in the stowed configuration (i.e. the configuration depicted in FIG. 1). Each socket includes a slot 116 for accepting an earth pin, a slot 118 for accepting a live pin and a slot 120 for accepting a neutral pin. The slots of each socket are coupled to the appropriate pins of the multi-plug adaptor so that power can be supplied to them, and hence to any plugs plugged into those sockets.

As with conventional UK sockets, in a particularly preferred arrangement the main body 122 of the multi-plug adaptor preferably includes internal gates that obstruct access to electrical contacts within the live and neutral slots of each socket until an earth pin has been plugged into the corresponding earth slot.

Figure 33:
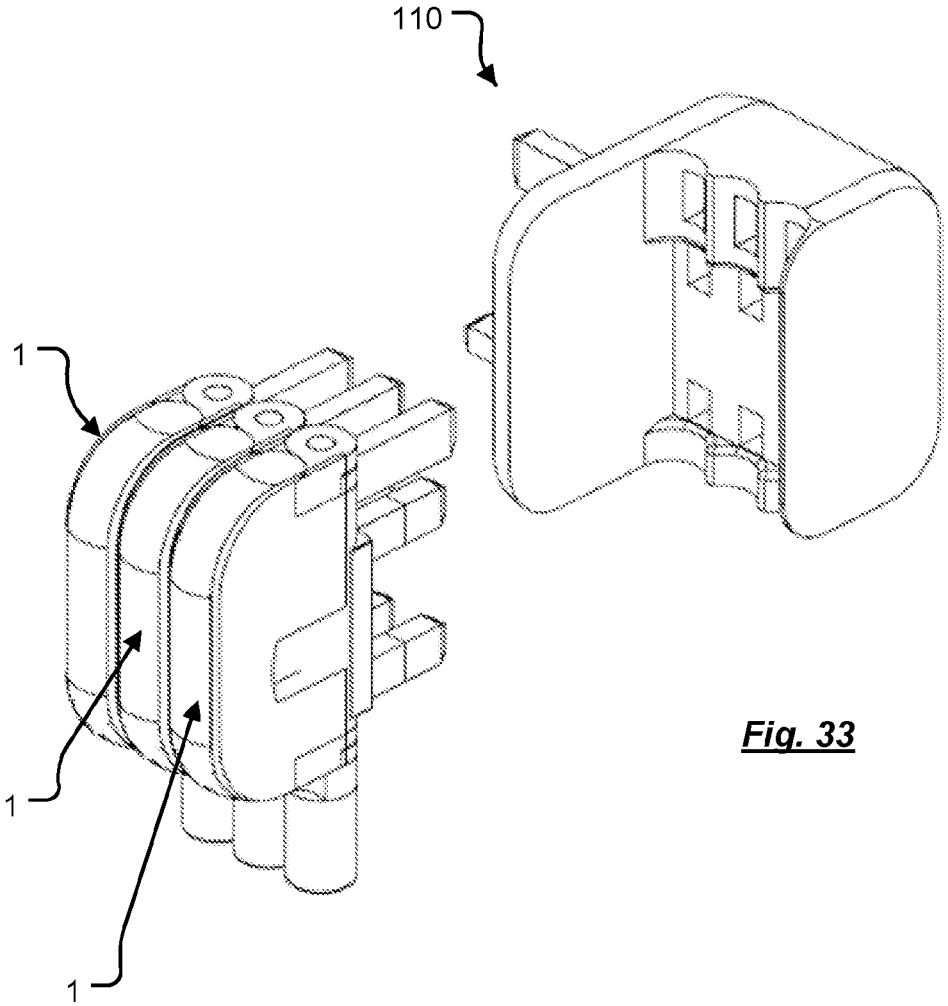
FIGS. 33 and 34 show the adaptor of FIGS. 31 and 32 in use.
Figure 34:
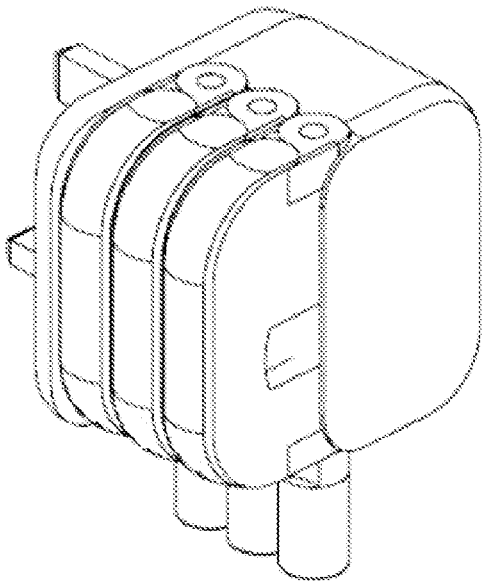

As can be seen from FIGS. 33 and 34, the multi-plug adaptor 110 is not much larger than a conventional three-pin plug, and when used in conjunction with plugs of the type shown in FIG. 1 the multi-plug adaptor 110 enables a plurality of such plugs to be readily coupled to the power supply. The adaptor of this particular arrangement allows up to three plugs to be connected, but it will be appreciated that adaptors with a larger or a smaller number of sockets 114 may instead be provided.

Figure 35:
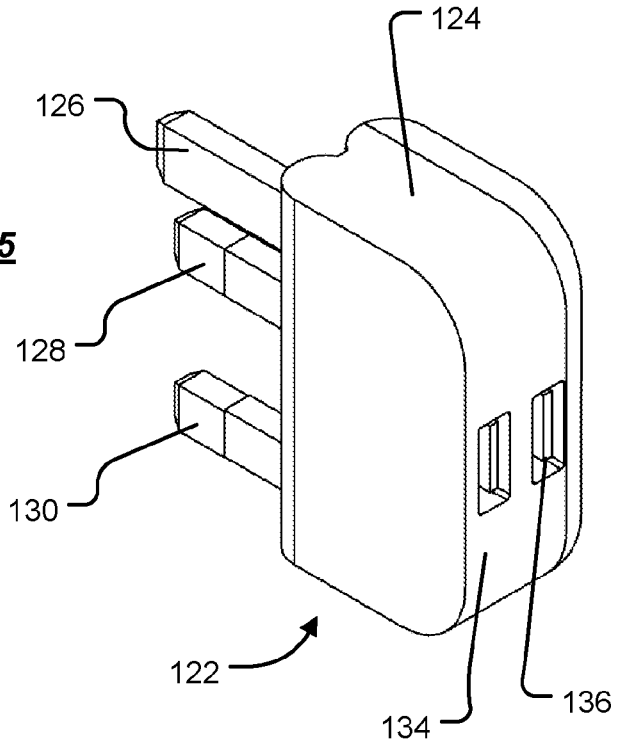
FIGS. 35, 36 and 37 are rear right perspective, front left perspective and top plan views, respectively of a USB plug for use with the adaptor of FIG. 31.
Figure 36:
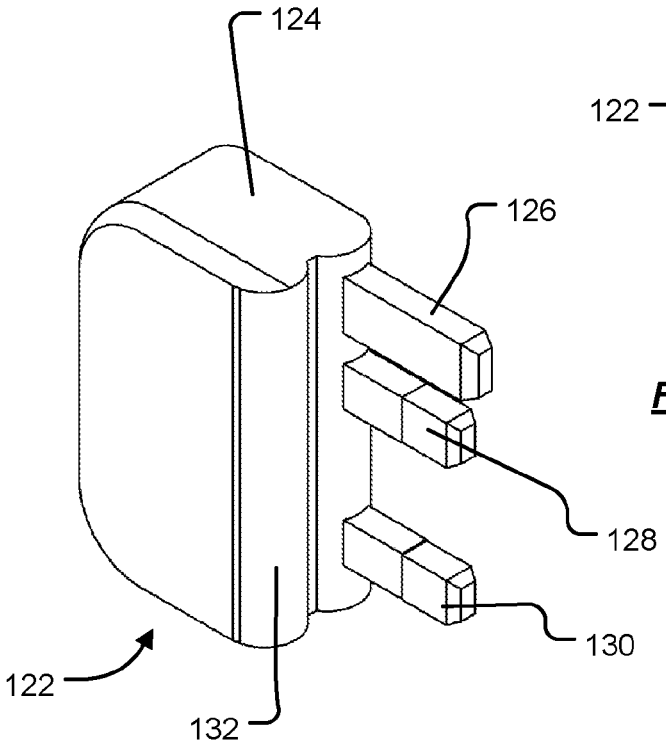
Figure 37:
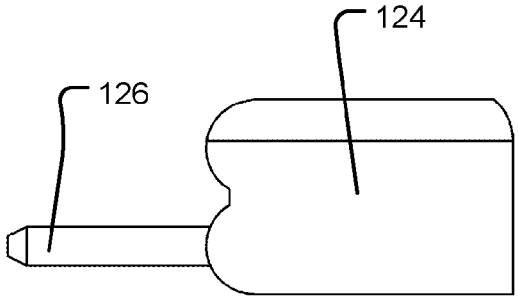

FIGS. 35, 36 and 37 are rear right perspective, front left perspective and top plan views, respectively of a USB plug 122 for use with the adaptor of FIG. 31. The USB plug 122 comprises a housing 124 that has earth 126, live 128 and neutral 130 pins extending from a profiled front face 132 that is shaped to co-operate with the sockets 114 of the multi-plug adaptor of FIG. 31. A rear face 134 of the housing includes—in this particular arrangement—two USB sockets 136 that co-operating USB connectors can be plugged into. As will be appreciated, in other configurations a larger or smaller number of USB connectors may be provided.

Within the housing 124 there is provided a transformer that is configured to step down mains voltage from the adaptor 110 to a USB compatible level—for example 5 to 9 volts.

Figure 38:
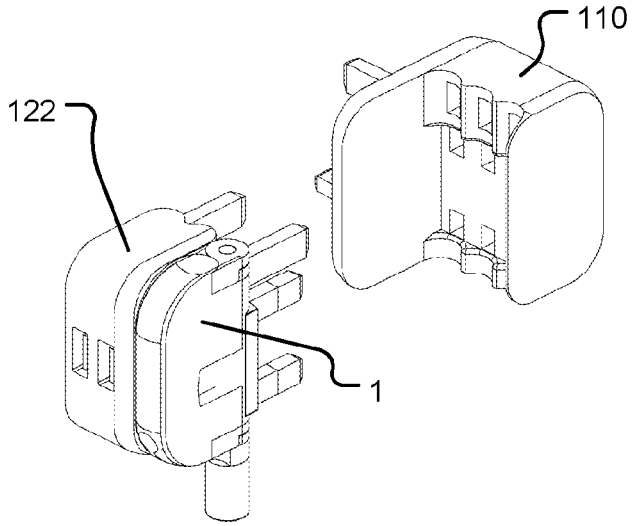
FIGS. 38 to 40 shown the USB plug of FIGS. 35 to 37 in use with a plug as described herein and a multi-plug adapter as shown in FIGS. 31 and 32.
Figure 39:
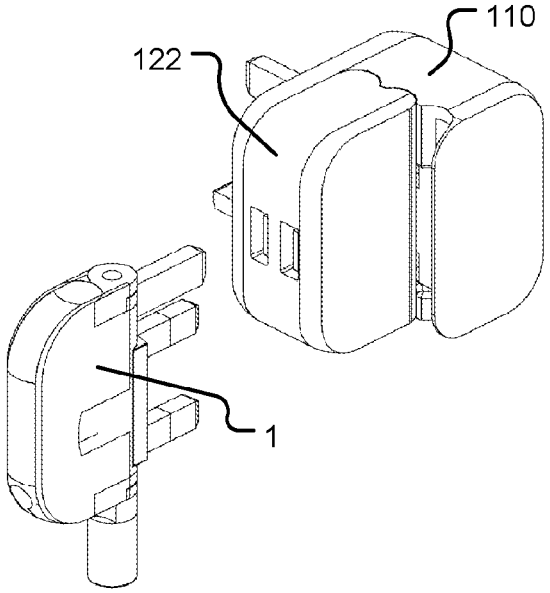
Figure 40:
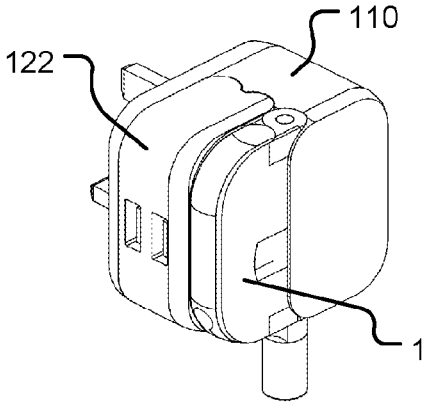

FIGS. 38 to 40 depict a USB plug 122 of the type shown in FIG. 35 being plugged, along with a plug 1 of the type shown in FIG. 1, into a multi-plug adaptor 110 of the type shown in FIG. 31. As can be seen from FIGS. 39 and 40, the resulting arrangement provides a particularly compact solution for powering two USB connected devices and one plug connected device. To achieve similar levels of connectivity with currently available equipment, it is likely that one would have to use a device such as a multi-gang extension lead, which device would be significantly larger than the arrangement provided in FIG. 40.

Figure 41:
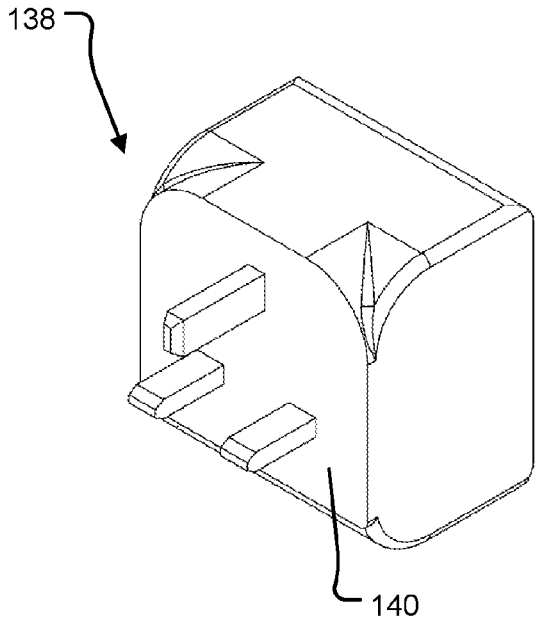
FIGS. 41 to 45 show a multi-plug adapter for use with the plug of FIG. 23.
Figure 42:
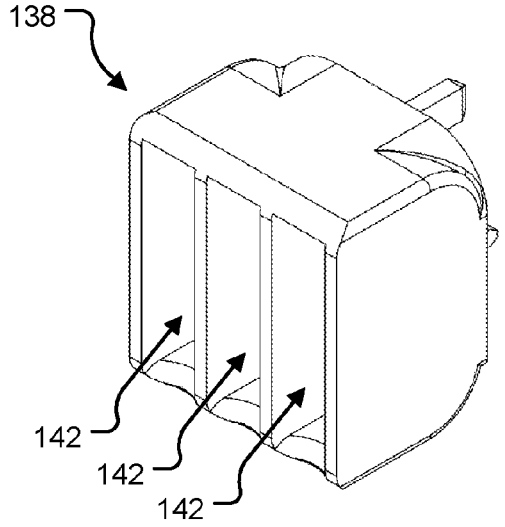

FIGS. 41 and 42 are front and rear perspective views, respectively, of a multi-plug adapter 138 for use with the plug 100 of FIGS. 23 to 28. As shown in FIG. 41. a front face 140 of the adapter has (in this instance) three pins projecting from it. As previously explained, in other arrangements a fewer or greater number of pins may project from the front face.

Figure 43:
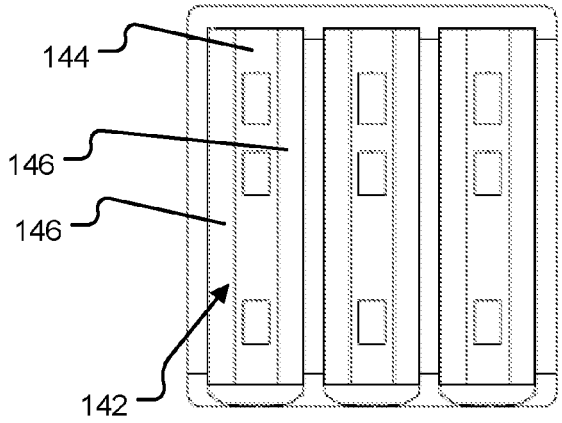
Figure 44:
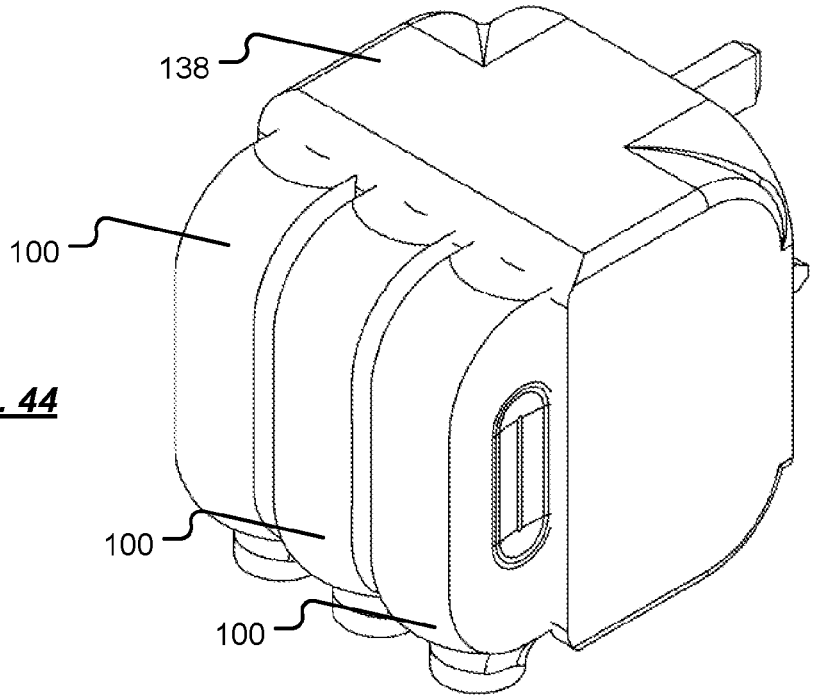
Figure 45:
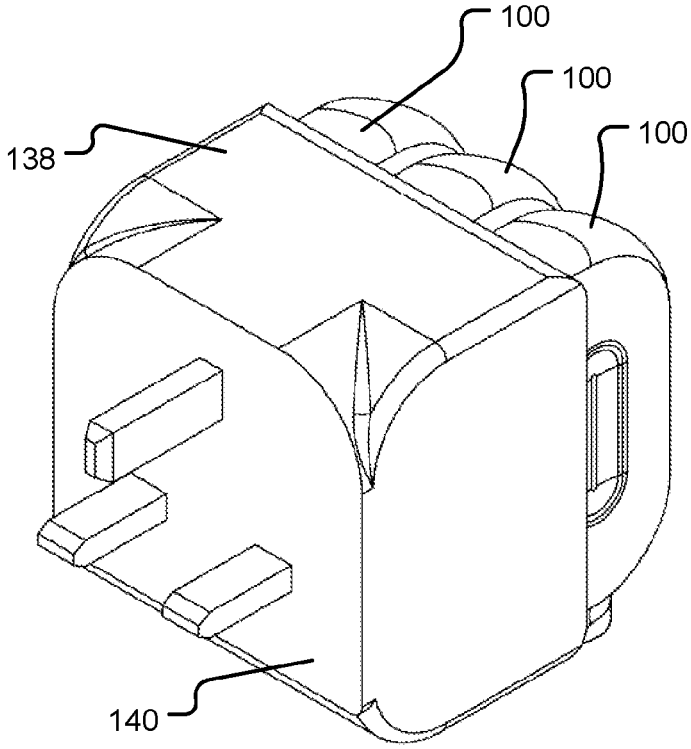

The rear of the adaptor 138 includes a plurality of sockets 142 into each of which a said plug 100 may be inserted. FIG. 43 is a rear elevation of the adaptor 138, and as can be seen in this figure, an upstanding column 144 in which earth, live and neutral slots are provided projects outwardly from a rear wall of each socket. The projecting columns 144 cooperate with the socket walls to define valleys 146 on either side of each projecting column into which the wings 102, 104 extend when a plug 100 is inserted into a socket 142. Referring now to FIGS. 44 and 45, there is depicted a schematic representation of an adaptor 138 of the type shown in FIG. 41, into which three plugs 100 have been plugged.

As will be appreciated, the adaptor of this arrangement provides another compact arrangement for coupling (in this instance) three plug to the mains electrical supply.

Figure 46:
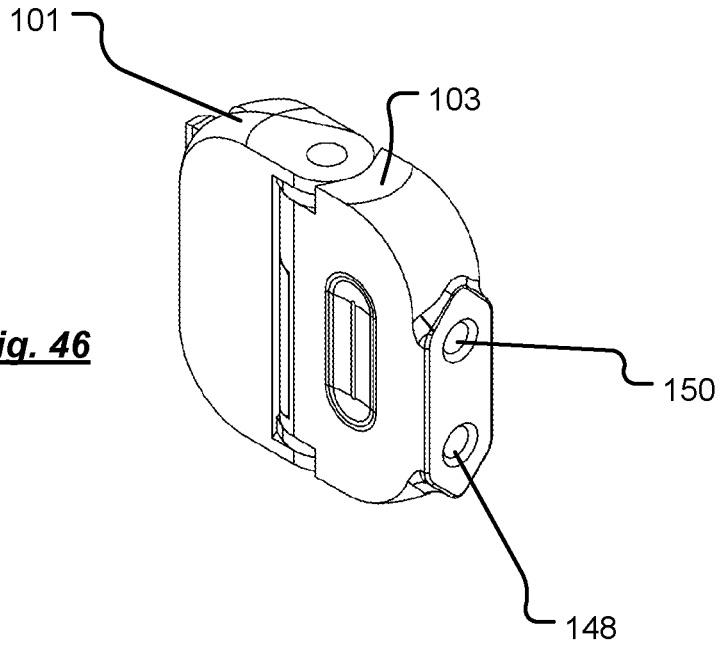
FIGS. 46 to 49 show a variety of schematic views of a three pin plug that functions as an adapter.
Figure 47:
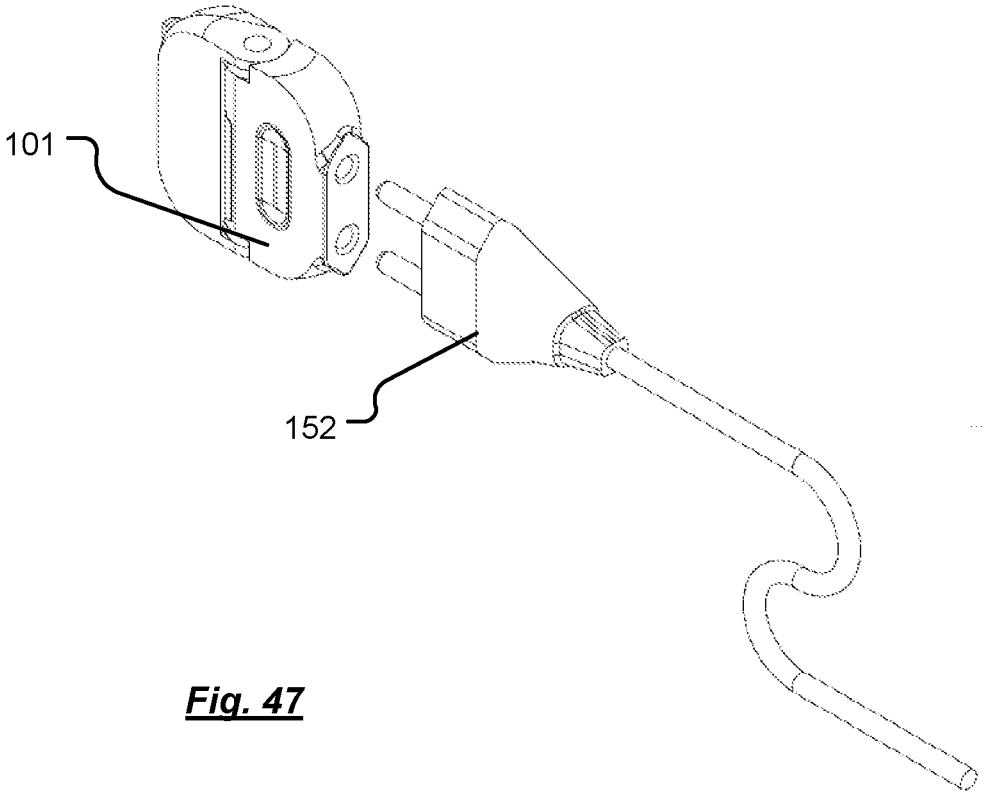
Figure 48:
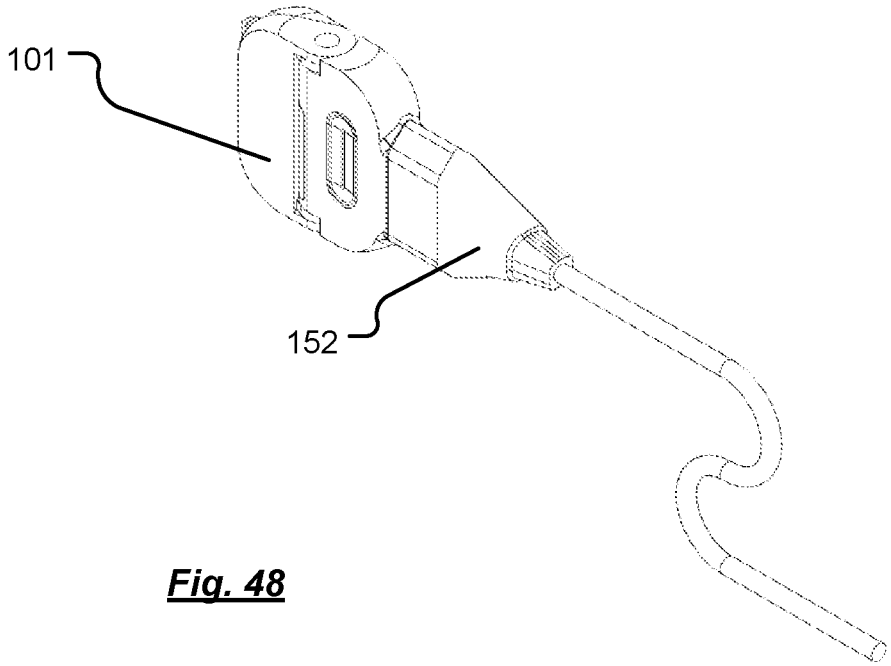
Figure 49:
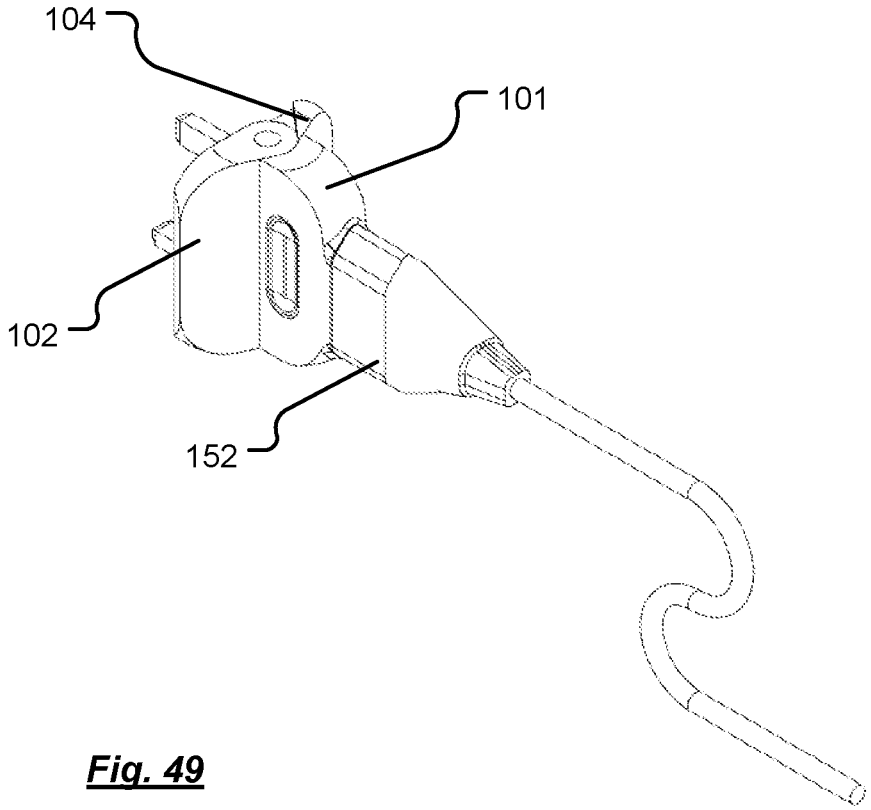

FIGS. 46 to 49 show another plug 101 that is similar to the plug 100 shown in FIGS. 23 to 28. The chief difference between the plug depicted in FIGS. 40 to 49 and the plug of FIGS. 23 to 28 is that the plug comprises a plug main body 103 includes first 148 and second 150 sockets that are configured to mate with the two pins of a European plug 152 (as shown in FIG. 47) and electrically couple the European plug 152 to the UK plug 101 (the effect of this being that the plug essentially functions as an adaptor which enables continental plugs to draw power from a three core socket into which the UK plug 101 is plugged. FIG. 48 is a schematic representation of the mated European plug 152 and UK plug 101, and FIG. 49 shows the arrangement of FIG. 48 with wings 102, 104 deployed.

Figure 50:
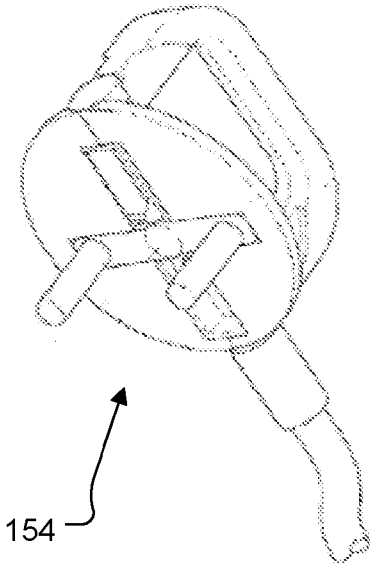
FIGS. 50 and 51 are perspective views of another plug that embodies the teachings of the present invention.
Figure 51:
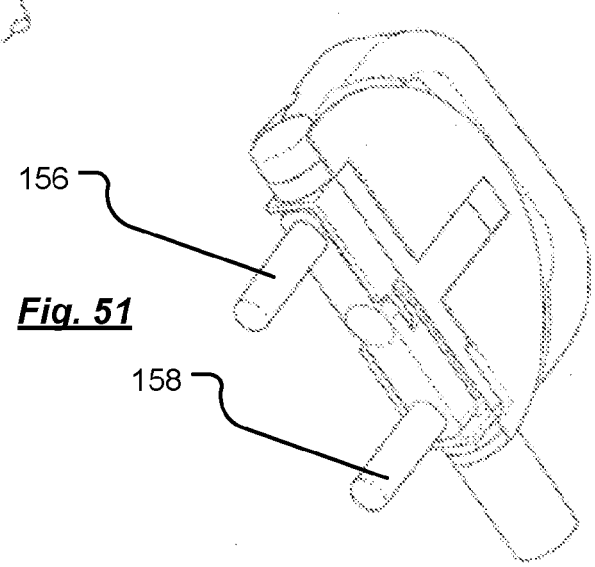

Referring now to FIGS. 50 and 51, there is depicted in FIG. 50 another plug in a deployed condition and in FIG. 51 the same plug with wings stowed. In this arrangement, the plug includes only first and second pins 156, 158 and no earth pin. This plug is, therefore, eminently suitable for use in continental Europe. The plug 154 depicted works in a very similar way to the plug 1 of FIG. 1.

Figure 52:
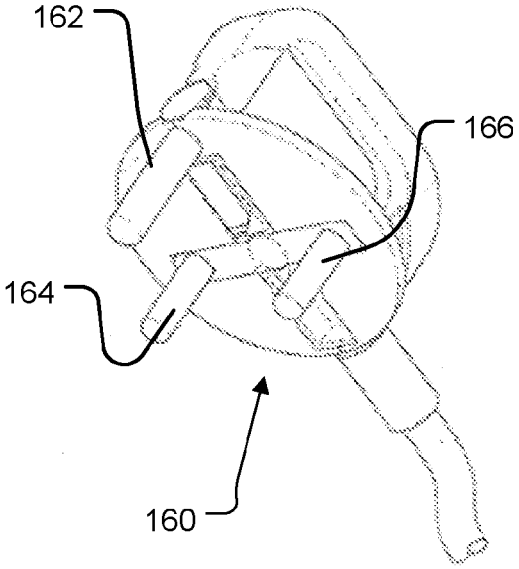
FIG. 52 is a perspective view of yet another plug that embodies the teachings of the present invention.

The plug 160 depicted in FIG. 52 is again very similar to the plug of FIG. 1. The chief difference here being that the pins 162, 164 and 166 of this plug are circular in cross-section. As a consequence, this plug is not suitable for use with UK plugs, but may well be suitable for use in other countries.

Figure 53:
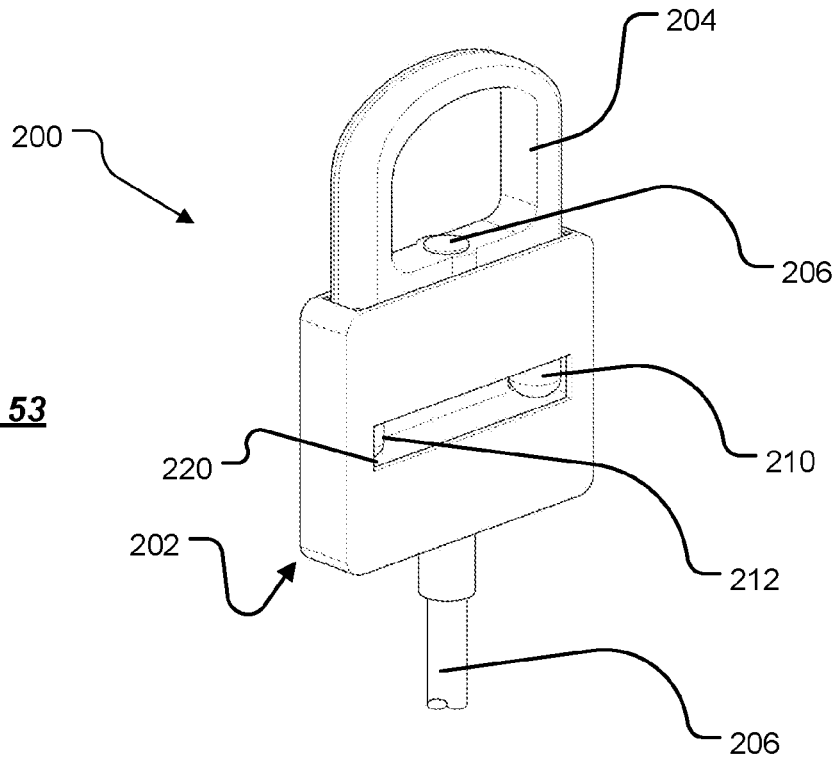
FIG. 53 is a perspective view of a further plug that embodies the teachings of the present invention.
Figure 54:
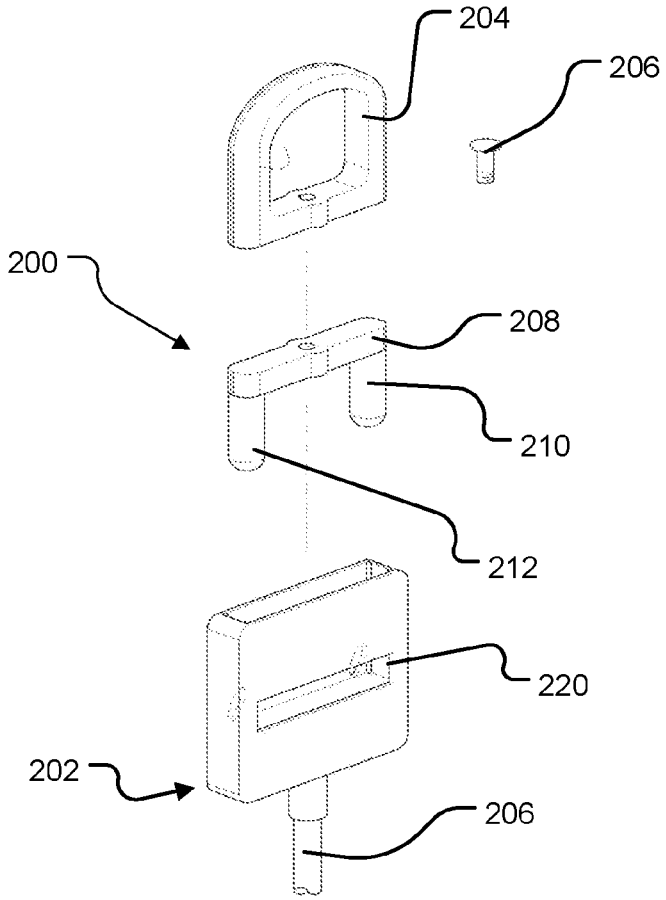
FIG. 54 is an exploded view of the plug depicted in FIG. 53.
Figure 55:
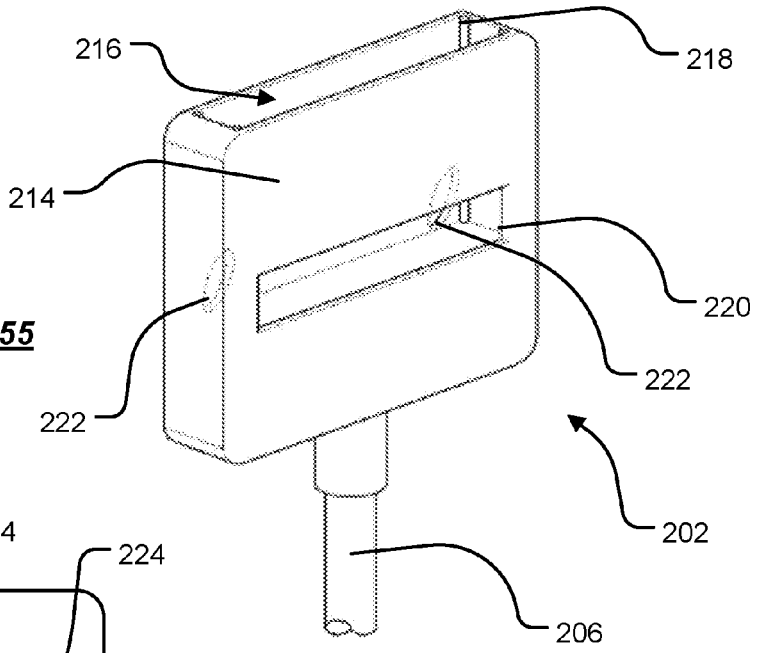
FIG. 55 is an enlarged view of part of the plug depicted in FIG. 53

FIG. 53 is a perspective view of yet another plug 200 (in a stowed configuration) that embodies the teachings of the present invention, and FIG. 54 is an exploded view of the plug shown in FIG. 53.

In this arrangement, the plug 200 comprises a housing 202 into which a plug main body 204 has been fitted for storage. In this illustrative example the plug 200 is configured for use with sockets of the type that are widely used throughout continental Europe. For other countries the plug may be differently configured, but the operating principles will remain the same. The plug housing 202 is coupled to an appliance by means of a cable 206, and the plug main body 204 is coupled to an arm 208 (FIG. 54) by means of a fixing 206. The arm 208 is coupled to a first 210 and a second 212 electrical pin, and the fixing 206 is configured to enable the arm 208 to rotate relative to the plug main body 204.

The housing 202 includes a hollow portion 214 that comprises an opening 216 at one end into which the plug main body 204 can be inserted for storage when the arm 208 is parallel thereto. The housing includes a number of internal ribs 218, in this instance one rib in each corner of the hollow portion 214, that serve to abut against and firmly hold the plug main body 204 in the housing 202 when it has been inserted into the open end 216 thereof.

Figure 56:
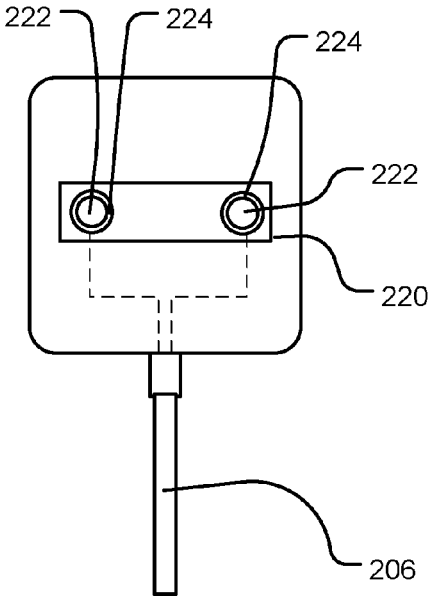
FIG. 56 is a schematic front elevation of the plug shown in FIG. 53.

The housing 202 further comprises a lateral slot 220 that also opens to the hollow portion 214 and provides access—in this particular arrangement—to a pair of openings 222 in an opposite face of the housing 202. The openings 222 are electrically coupled, as shown in FIG. 56, to cable 206 and are configured to make an electrical connection with respective electrical pins of the type carried by the arm 208 when the pins are pushed through the openings. To implement this, the openings 222 may each be encircled by a metal ring 224 that is electrically coupled to the wires of the cable 206 (designated by the broken lines in FIG. 56) and against which the electrical pins abut when pushed through the openings 222.

Figure 57:
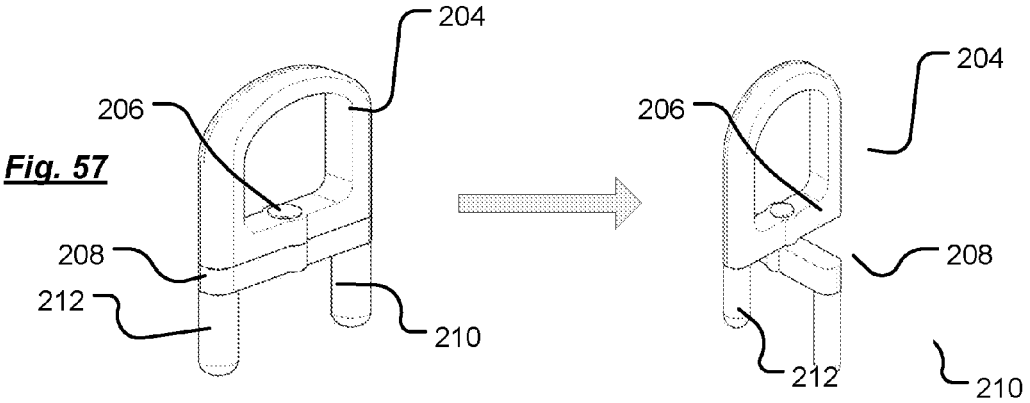
FIG. 57 is a schematic illustration of part of the plug shown in FIG. 53 in a different configuration.
Figure 58:
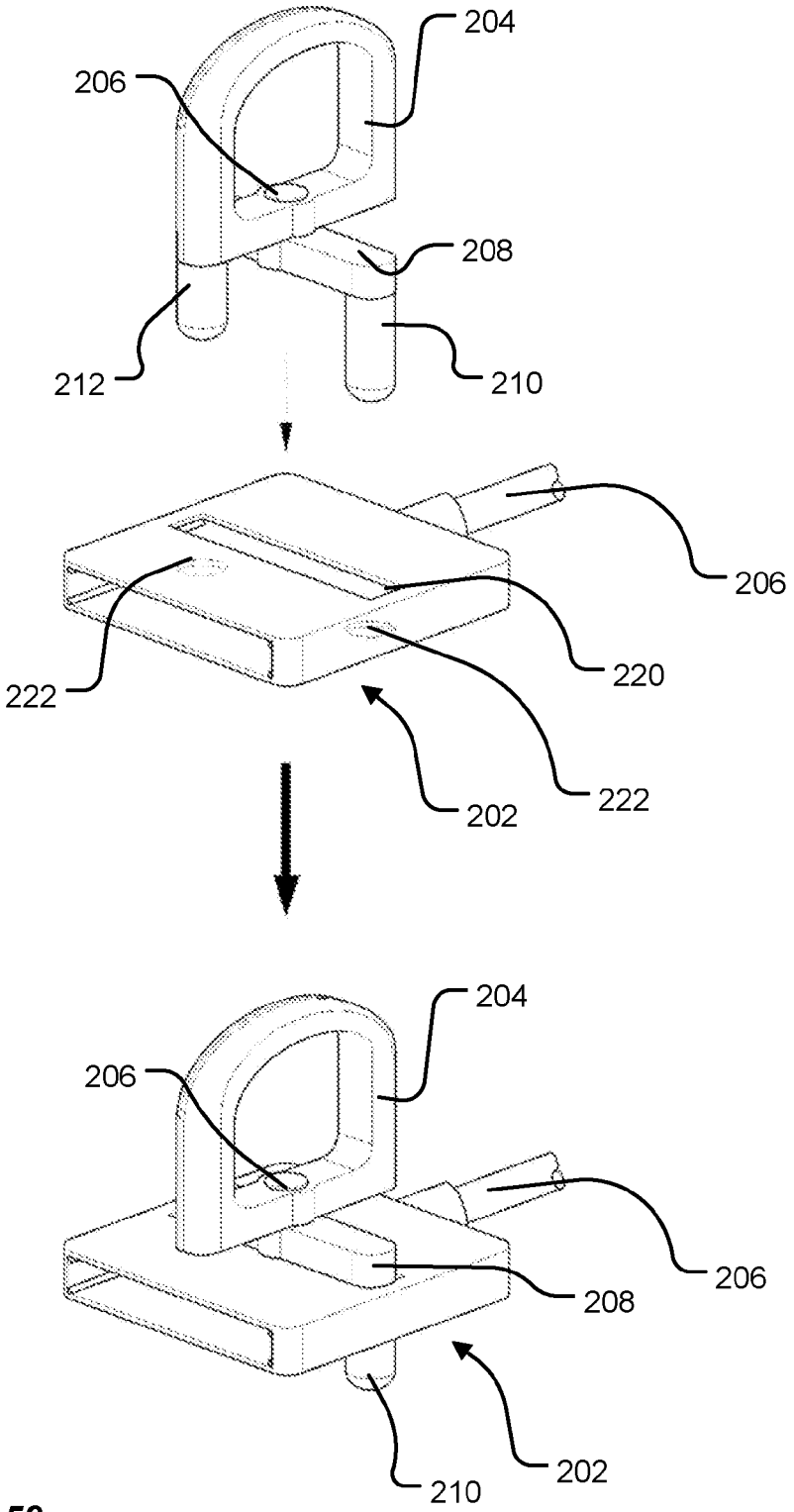
FIG. 58 is a schematic representation of one way that the plug components of the plug shown in FIG. 53 may be reassembled for use.

To use the plug 200 one must first remove the plug main body 204 from its storage position in the housing 202. Although this step is not essential, one can then (as shown in FIG. 57) rotate the arm 208 relative to the plug main body 204 so that the arm is generally perpendicular thereto. Next, as shown in FIG. 58 the arm 208 of the plug main body 204 is pushed into the slot 220 thereby pushing the pins 210, 212 carried by the arm 208 through respective openings 222 so that the pins project from the housing.

At this point the electrically conductive pins 210, 212 abut against the metal rings 224 encircling the openings 222, thereby making electrical connections between the pins 210, 212 and the wires of the cable 206. The plug 200 can then be plugged into a mains socket with which it cooperates to permit the supply of electricity from the mains socket, via the connected pins 210, 212 and rings 224, to the cable 206.

Figure 59:
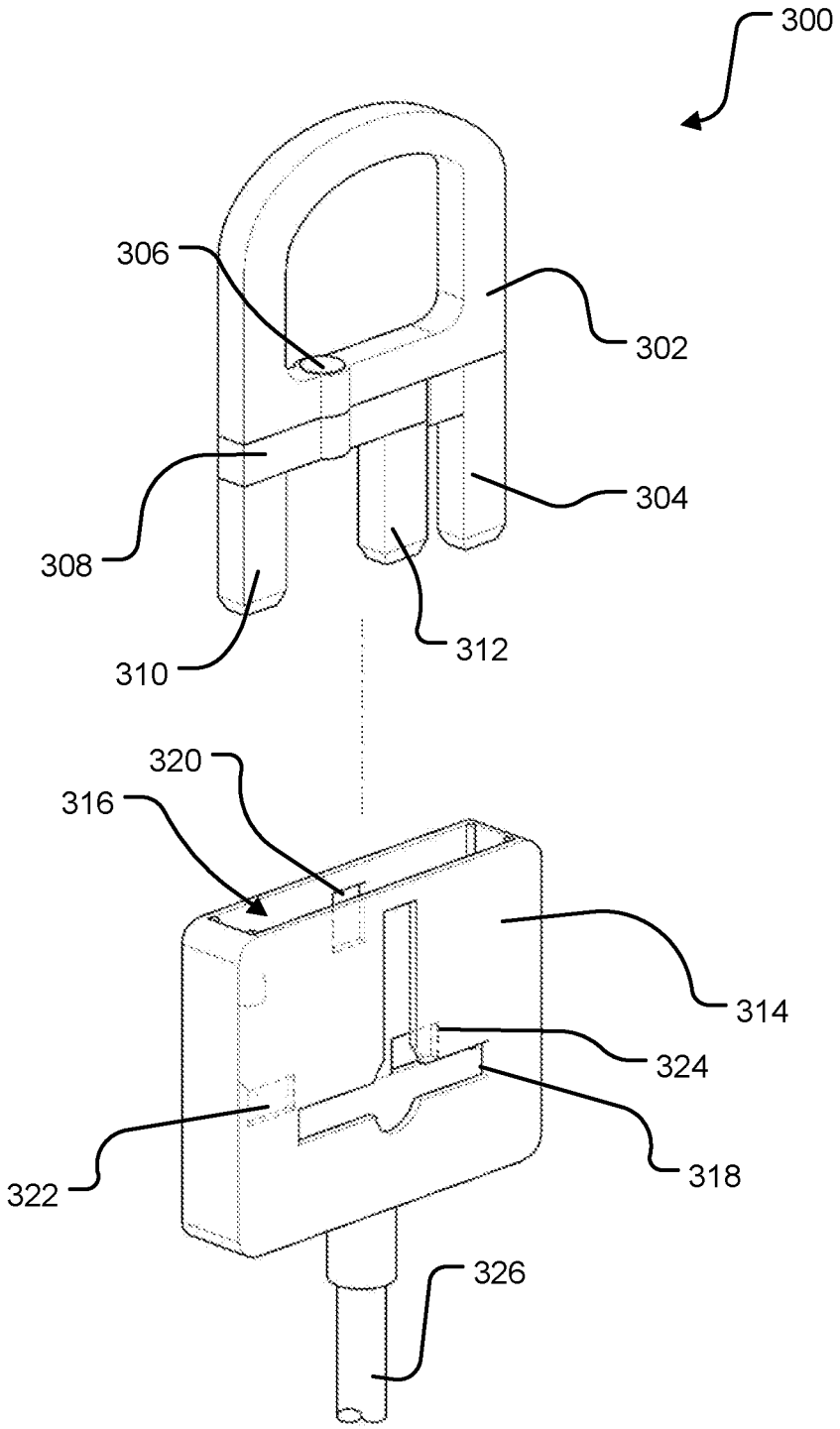
FIG. 59 is a perspective view of a yet further plug that embodies the teachings of the present invention.

FIG. 59 is a schematic representation of yet another plug 300 that embodies the teachings of the invention. The plug of this arrangement is similar to that of FIG. 53, the chief difference being that the plug main body 302 carries a fixed first pin 304 as well as being coupled by coupling 306 to a rotatable arm 308 that carries second and third pins 310, 312.

As with the arrangement shown in FIG. 53, the plug main body 302 cooperates with a housing 314 which is provided with a hollow storage compartment 316 at one end into which the plug 302 can be fitted for storage. The housing includes a T-shaped slot 318 which provides access to three openings 320, 322, 324 in an opposite face of the housing to that in which the slot 318 is provided—each of the openings being shaped and configured to accommodate one of the aforementioned pins 304, 310, 312.

To use the plug of this arrangement, the arm 308 is first rotated by 90 degrees relative to the plug main body 302. The plug main body is then fitted into the slot so that the fixed pin 304 extends through and projects from opening 320, and so that the pins 310, 312 carried by the arm 308 extend through and project from respective openings 322, 324. The plug can then be plugged into a mains electrical socket for the supply of power from the socket to an appliance coupled to the cable 326.

In one envisaged arrangement, only openings 322 and 324 are electrically coupled to the cable 326 and fixed pin 304 is a dummy pun that functions only to open internal safety gates of a socket with which the plug cooperates. In another envisaged implementation opening 320 may be electrically coupled to an earth wire of cable 326 and be enabled to electrically couple to earth an appliance to which the cable is connected.

It will be appreciated from the foregoing that the teachings of the present invention do indeed provide a compact plug that is of a similar thickness to modern laptop computers such as the MacBook or iPad.

It will also be appreciated that whilst various aspects and embodiments of the present invention have heretofore been described, the scope of the present invention is not limited to the particular arrangements set out herein and instead extends to encompass all arrangements, and modifications and alterations thereto, which fall within the scope of the appended claims.

For example, as mentioned herein it is possible for the earth pin to be a dummy pin, in which case it would be possible to two-core instead of three core cabling to connect the plug to an appliance. It is also possible for the plug to include a transformer, in which case the plug need only be coupled to the appliance by two-core cabling.

It is also eminently conceivable for the plug/adaptor of FIG. 46 to include a different socket configuration that is suited for another jurisdiction.

Skilled persons will further recognise that the arrangements depicted in FIGS. 4, 10 and 11 and in FIGS. 13 to 20 could readily be adapted so that instead of the arm 17 carrying a peg 59 or the arm being fittable onto a peg formed on the plug main body, the arm and plug main body could be coupled together by a peg that is separate from both the arm and the plug main body. In such an arrangement the peg could be pushed through an aperture in the arm and into a suitable socket in the plug main body to couple the arm thereto. A variety of alternative arrangements will be immediately apparent to persons of ordinary skill in the art.

It will also be apparent to persons skilled in the art that alternative types of connector other than USB could be accommodated. For example, the plug could be configured to accommodate Firewire™, serial, parallel or other connectors.

Lastly, it should also be noted that whilst the accompanying claims set out particular combinations of features described herein, the scope of the present invention is not limited to the particular combinations hereafter claimed, but instead extends to encompass any combination of features herein disclosed. In particular, features of any embodiment or arrangement described herein may be combined with features of any other embodiments that are herein disclosed.

The invention claimed is:

1. An electrical plug comprising:

a plug main body;

a plurality of electrical pins;

an arm configured to carry said plurality of pins, wherein the arm is coupled to said plug main body and is rotatable relative thereto between a stowed position where the arm is generally linearly aligned with the plug main body, and a deployed position where the arm has rotated relative to the plug main body so as to be generally perpendicular thereto; and first and second wings pivotally attached to said plug main body, said first and second wings being movable relative to said plug main body and said arm from a stowed position to a deployed position.

2. An electrical plug according claim 1, wherein said arm is rotatable through 90 degrees or more relative to said plug main body.

3. An electrical plug according to claim 1, wherein said arm is rotatable through 360 degrees relative to said plug main body.

4. An electrical plug according to claim 1, wherein the first and second wings are generally parallel to said plug main body when the wings are in said stowed position.

5. An electrical plug according to claim 1, wherein the first and second wings lie adjacent and abut said plug main body when the wings are in said stowed position.

6. An electrical plug according to claim 1, wherein the first and second wings extend, in said stowed position, to at least partly cover at least some of said plurality of electrical pins.

7. An electrical plug according to claim 1, wherein the first and second wings are generally perpendicular to said plug main body when said wings are in said deployed position.

8. An electrical plug according to claim 7, wherein said wings obstruct access to at least some of said electrical pins when said plug is plugged into a socket and said wings are in said deployed position.

9. An electrical plug according to claim 1, wherein said plug comprises a resilient bias configured to retain said arm in a predetermined position.

10. An electrical plug according to claim 9, wherein said resilient bias is configured to retain said arm in said deployed position.

11. An electrical plug according to claim 10, wherein said plug main body includes a generally transverse channel in which said arm is retained by said resilient bias.

12. An electrical plug according to claim 1, wherein said arm comprises a projecting peg, and said plug main body comprises a socket configured to receive said peg.

13. An electrical plug according to claim 12, wherein the projecting peg on said arm is configured to snap-fit in said socket.

14. An electrical plug according to claim 13, wherein the projecting peg is held in said socket by a retainer.

15. An electrical plug according to claim 14, wherein said retainer comprises a circlip.

16. An electrical plug according to claim 1, wherein said plug main body comprises a projecting peg, and said arm comprises a socket configured to receive said peg.

17. An electrical plug according to claim 1, wherein said plug main body and said arm are coupled together for relative rotation by a peg separate from both said plug main body and said arm.

18. An electrical plug according to claim 1, wherein said plug main body includes a transformer.

19. An electrical plug according to claim 18, wherein said transformer is configured to step down mains voltage to a lower voltage.

* * * * *